US008270860B2

(12) United States Patent
Fujimori et al.

(10) Patent No.: US 8,270,860 B2
(45) Date of Patent: Sep. 18, 2012

(54) IMAGE FORMING APPARATUS

(75) Inventors: Takashi Fujimori, Moriya (JP); Shunsuke Nishimura, Tokyo (JP); Asahiro Nakayoshi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 12/793,805

(22) Filed: Jun. 4, 2010

(65) Prior Publication Data

US 2010/0310265 A1 Dec. 9, 2010

(30) Foreign Application Priority Data

Jun. 8, 2009 (JP) ..... 2009-137043

(51) Int. Cl.
*G03G 15/043* (2006.01)

(52) U.S. Cl. ..... 399/51; 399/48

(58) Field of Classification Search ..... 399/51, 399/48, 49

See application file for complete search history.

(56) References Cited

U.S. PATENT DOCUMENTS

| | | | | |
|---|---|---|---|---|
| 6,795,099 | B2 * | 9/2004 | Koga et al. | 347/129 |
| 2008/0124125 | A1 * | 5/2008 | Hirano | 399/151 |
| 2010/0040390 | A1 * | 2/2010 | Makino | 399/51 |
| 2011/0221847 | A1 * | 9/2011 | Takezawa | 347/118 |

FOREIGN PATENT DOCUMENTS

| | | | |
|---|---|---|---|
| JP | 8-130626 | A | 5/1996 |
| JP | 2005-66827 | A | 3/2005 |

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

An image forming apparatus which makes it possible to resolve correction error of potential unevenness caused by insufficient mounting accuracy of an image carrier, in a relatively short time period without performing a conventional operation for removing the image carrier. The image forming apparatus includes a photosensitive drum, an exposure unit, an electrical potential sensor, a shading data ROM, and a CPU. Electrical potential data items associated with respective positions on the surface of the photosensitive drum are stored in the shading data ROM. The CPU corrects an exposure amount onto the photosensitive drum by the exposure unit, based on the electrical potential data read from the ROM, and based on the result of correction, adjusts timing for reading out the data.

7 Claims, 22 Drawing Sheets

IMAGE FORMING APPARATUS

BACKGROUND OF THE INVENTION

1. Field of the Invention

The present invention relates to an image forming apparatus that performs electrophotographic image formation.

2. Description of the Related Art

Conventionally, there has been proposed an electrophotographic image forming apparatus that charges a rotating image carrier (photosensitive drum) using a charging section, exposes the same using an exposure section to form an electrostatic latent image on the surface of the photosensitive drum, develops the electrostatic latent image with toner, and transfers a toner image thus formed onto a recording material, to thereby form an image on the recording material.

For the electrophotographic image forming apparatus, there has been proposed a technique of correcting density unevenness in a toner image, caused by in-plane (surface) unevenness in potential characteristics (potential unevenness) on the photosensitive drum (see Japanese Patent Laid-Open Publication No. 2005-66827). According to the technique disclosed in Japanese Patent Laid-Open Publication No. 2005-66827, unevenness in electrical potential used for image formation, which will occur on the surface of the photosensitive drum during the image formation, is stored as data of electrical potential or data of density in the image forming apparatus in advance. Then, when performing exposure of the photosensitive drum by the exposure section, the exposure intensity is adjusted according to the data of electrical potential or the data of density, whereby the potential unevenness on the photosensitive drum is offset. Details of an example of control performed at the time will be given hereafter.

Referring first to FIG. 8, there is shown an example of a graph of potential unevenness on the photosensitive drum of the image forming apparatus. The potential unevenness is caused by in-plane unevenness which affects the easiness of charging when charging the photosensitive drum using the charging section, and unevenness in a drop in electrical potential which occurs with respect to a certain exposure intensity when the photosensitive drum is subjected to exposure using the exposure section. The graph shown in FIG. 8 will be explained hereinafter in the description of an embodiment of the present invention.

Referring next to FIG. 22, there is shown a distribution of the electrical potential on the photosensitive drum at each point on one line in a main scanning direction when the exposure section of the image forming apparatus scans the photosensitive drum along a direction of the axis of the photosensitive drum (in the main scanning direction) and thereby forms an electrostatic latent image in synchronism with rotation of the photosensitive drum. In a case where the electrical potential on the photosensitive drum after being subjected to charging and exposure suitable for image formation is 50V, as illustrated in FIG. 22, the exposure intensity is increased where the electrical potential is higher than 50V, and is lowered where the electrical potential is lower than 50V, according to potential characteristics detected when uniform charging and exposure is performed. This corrects uneven potentials into uniform potential.

In the image forming apparatus, the above-described correction is performed for each scan line when performing exposure of the photosensitive drum using the exposure section, whereby it becomes possible to correct potential unevenness on the whole photosensitive drum. Further, in correcting the potential unevenness on the photosensitive drum in a direction of rotation of the photosensitive drum i.e. in a sub scanning direction of the exposure section, based on the exposure intensity, it is necessary to control the rotational phase of the photosensitive drum, and at the same time, to change the exposure intensity according to the rotational phase.

One known method of controlling the rotational phase of the photosensitive drum uses a home position sensor. According to this method, the control is performed in the following manner: When performing image creation to form an electrostatic latent image on the photosensitive drum, the home position of the photosensitive drum is detected by the home position sensor when a certain time period required for stabilizing the rotation of the photosensitive drum elapses after the start of rotation of the photosensitive drum, and then, the rotational phase dependent on rotation performed starting from the time of detection of the home position is measured. According to the phase of the photosensitive drum thus controlled, the potential unevenness is corrected by changing the exposure intensity in the sub scanning direction, similarly to the potential unevenness correction in the main scanning direction.

Further, there has been proposed a method of, when a photosensitive drum is made in a manufacturing plant, measuring the above-mentioned potential unevenness on the photosensitive drum in advance and storing data of the measurement, which is formed as data defined with reference to a phase reference position on the photosensitive drum as a starting point, in a storage section of an image forming apparatus on which the photosensitive drum is mounted.

On the other hand, there has been known an image forming apparatus that produces a printout by adding tiny dots to an original image, and when copying the printout, determines whether the printout is permitted to be copied according to a usage restriction expressed by a pattern of the tiny dots (see Japanese Patent Laid-Open Publication No. H08-130626).

To stably read information expressed by the tiny dots during copying, it is important to cause the tiny dots added to the original image to be uniformly reproduced on an image surface. Therefore, it is necessary to correct the potential unevenness on the photosensitive drum during image formation which causes unevenness of the reproducibility of the tiny dots on the image surface.

However, if the home position of the photosensitive drum of the image forming apparatus does not coincide with the phase reference position on the photosensitive drum, the profile of the exposure intensity switching does not coincide with the actual potential unevenness on the photosensitive drum, and hence there is a high possibility that the potential unevenness is further increased. Particularly, in a case where the photosensitive drum and a member (flange) used for detecting the home position of the photosensitive drum are different members, unless the accuracy is high with which the two members are mounted to each other to form a unit, there is a high possibility that the potential unevenness is increased.

To solve such a problem, if respective correct mounting positions of the photosensitive drum and the member mounted to the photosensitive drum are searched for while performing image formation by the image forming apparatus, it is required to remove the photosensitive drum from the image forming apparatus each time to adjust the mounting positions. Particularly, the efficiency is largely lowered in a maintenance operation in which the photosensitive drum is often singly subjected to component replacement after removal from the unit formed by the photosensitive drum and accessories mounted thereon.

SUMMARY OF THE INVENTION

The present invention provides an image forming apparatus which makes it possible to resolve correction error of potential unevenness caused by insufficient mounting accuracy of an image carrier, in a relatively short time period without performing a conventional operation for removing the image carrier.

The present invention provides an image forming apparatus that charges an image carrier by a charging unit, exposes the image carrier by an exposure unit to thereby form an electrostatic latent image on the image carrier, and transfers an image formed by developing the electrostatic latent image by a developing unit, onto a recording material, comprising a storage unit configured to store electrical potential data items measured in association with respective positions on the surface of the image carrier, a correction unit configured to correct an amount of exposure onto the image carrier by the exposure unit based on each of the electrical potential data items read from the storage unit, and an adjustment unit configured to adjust timing in which the correction unit starts correcting the amount of exposure, based on a result of correction of the amount of exposure by the correction unit.

According to the present invention, the amount of exposure to the image carrier by the exposure unit is corrected based on data of electrical potential on the surface of the image carrier, and timing in which correction of the amount of exposure is started is adjusted based on the result of the correction of the amount of exposure. This makes it possible, when correcting the potential unevenness on the surface of the image carrier, on an as-needed basis, to resolve the correction error of the potential unevenness caused by insufficient mounting accuracy of the image carrier in a relatively short time period without performing a conventional operation for removing the image carrier.

Further features of the present invention will become apparent from the following description of exemplary embodiments with reference to the attached drawings.

DETAILED DESCRIPTION OF THE EMBODIMENTS

The present invention will now be described in detail below with reference to the accompanying drawings showing embodiments thereof.

Figure 1:
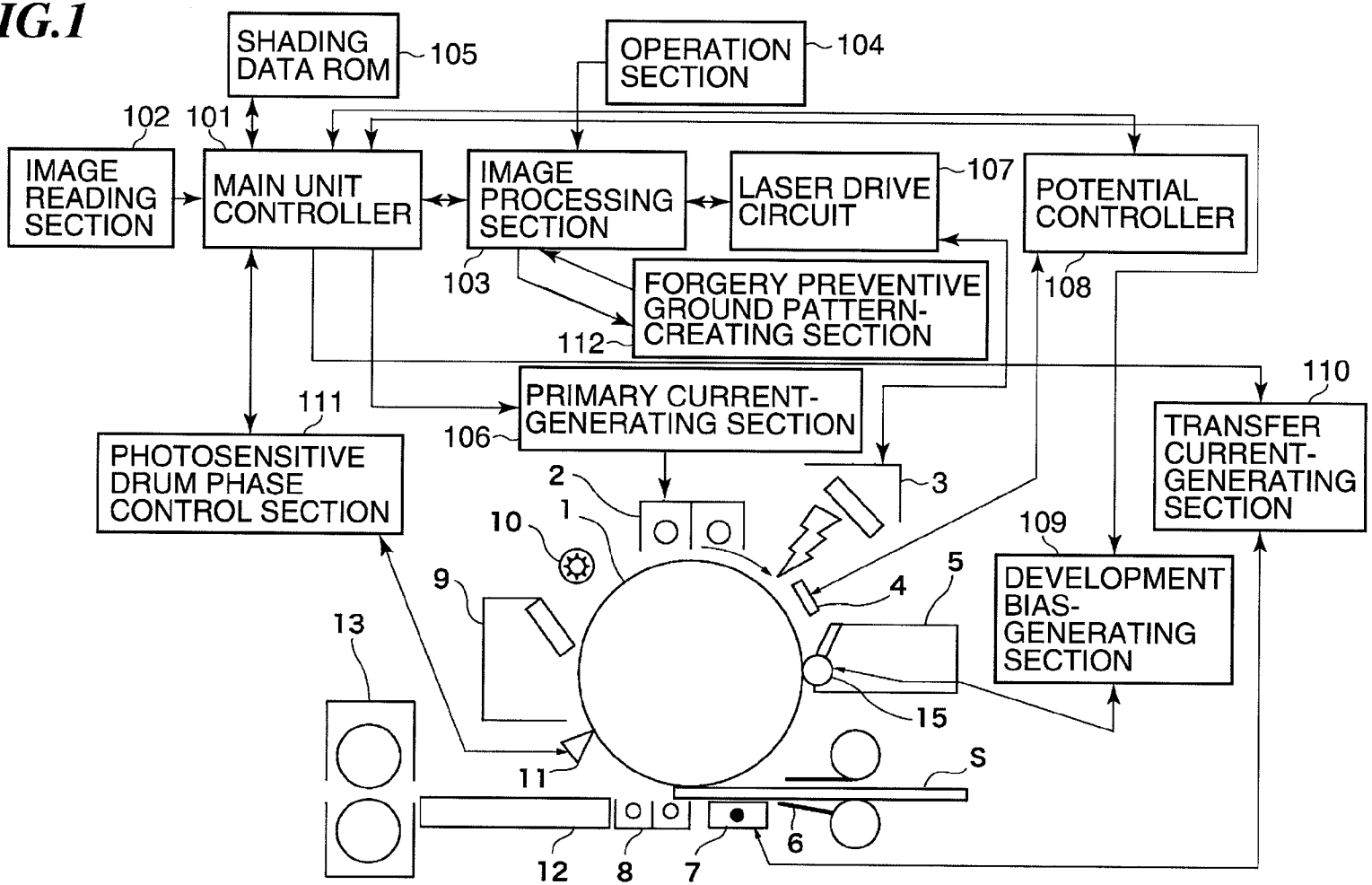
FIG. 1 is a schematic block diagram of an image forming apparatus according to first and second embodiments of the present invention.

FIG. 1 is a schematic block diagram of an image forming apparatus according to a first embodiment of the present invention.

In FIG. 1, the image forming apparatus comprises a photosensitive drum 1 (image carrier), a charging section 2, an exposure section 3, a potential sensor 4, a development section 5, a transfer section 7, a separating section 8, a cleaning section 9, a pre-image-formation exposure section 10, a photosensitive drum home position sensor 11, a conveying section 12, and a fixing section 13. The image forming apparatus performs image formation by electrophotography, and the photosensitive drum 1, the charging section 2, the exposure section 3, the development section 5, the transfer section 7, the fixing section 13, and so forth forms an image forming section.

The image forming apparatus further comprises a main unit controller 101, an image reading section 102, an image processing section 103, an operation section 104, a shading data ROM 105, a primary current-generating section 106, and a laser drive circuit 107. The image forming apparatus further comprises a potential controller 108, a development bias-generating section 109, a transfer current-generating section 110, a photosensitive drum phase control section 111, a forgery-preventive ground pattern-creating section 112.

First, a description will be given of a configuration and operation of an image forming system of the image forming apparatus. The charging section 2, the exposure section 3, the potential sensor 4, the development section 5, the transfer section 7, the separating section 8, the photosensitive drum home position sensor (hereinafter referred to as the photosensitive drum HP sensor) 11, the cleaning section 9, and the pre-image-formation exposure section 10 are arranged in a manner surrounding the photosensitive drum 1 clockwise as viewed in FIG. 1. In forming an electrostatic latent image on an outer peripheral surface of the photosensitive drum 1, the outer peripheral surface of the photosensitive drum 1 is electrically charged by the charging section 2, and is then irradiated with laser light corresponding to image data read from an original by the image reading section 102 using the exposure section 3 comprising a laser scanner, not shown.

The exposure section 3 performs exposure using laser light. More specifically, the exposure section 3 scans the photosensitive drum 1 by the laser light in a direction parallel to the rotational axis of the photosensitive drum 1 to thereby form an electrostatic latent image on the outer peripheral surface of the photosensitive drum 1 in synchronism with the rotation of the photosensitive drum 1. In this case, the direction parallel to the rotational axis of the photosensitive drum 1 is referred to as a main scanning direction, and a direction perpendicular to the main scanning direction is referred to as a sub scanning direction, in association with the operation of the exposure section 3. Further, it is also possible to control the intensity of exposure by the exposure section 3 so as to remove in-plane unevenness in the potential characteristics of the photosensitive drum 1 by a method described hereinafter. The potential sensor 4 measures the electrical potential according to a position on the outer peripheral surface of the photosensitive drum 1.

The development section 5 includes a development container, not shown, filled with a developer including toner, and performs a developing operation. The toner is conveyed onto an outer peripheral surface of a developer carrier 15 by rotation of an agitation member, not shown, while being positively charged within the development container of the development section 5. There is a slight gap between the photosensitive drum 1 and the developer carrier 15, and the development is performed via the gap. At this time, to improve the efficiency of development and at the same time to form a clear toner image having a high density on the photosensitive drum 1, a bias voltage including an AC component is applied to the developer carrier 15.

In the present embodiment, a toner image is formed using the photosensitive drum 1 which is positively charged and toner which is positively charged, by a known reversal development method. In this case, an electrical potential at each toner-non-attracting point on the outer peripheral surface of the photosensitive drum 1 is approximately 500V, and an electrical potential at each toner-attracting point on the same is approximately 50V. Further, a DC component of the bias voltage applied to the developer carrier 15 is approximately 250V.

On the other hand, a recording material S is conveyed to a transfer position in the vicinity of the photosensitive drum 1 by a sheet conveying and registration mechanism 6. The transfer section 7 transfers the toner image on the photosensitive drum 1 onto the recording material S by discharging electric current opposite in polarity from the charge of the toner, i.e. minus electric current by using a corona charger, not shown. The recording material S is separated from the photosensitive drum 1 by the separating section 8 in a state having the toner image attached thereon, and is conveyed to the fixing section 13 by the conveying section 12. The toner image is thermally fixed on the recording material S by the fixing section 13, and the recording material S is discharged out of the image forming apparatus by a sheet-discharging mechanism (not shown).

Next, a description will be given of a function of a control system of the image forming apparatus. The main unit controller 101 includes a CPU 120 (see FIG. 3), and performs control of the entire image forming apparatus. The image reading section 102 reads an image from the original. The image processing section 103 performs image processing on data of the read image. The operation section 104 is used when an operator makes various settings for the image forming apparatus. The shading data ROM 105 (storage unit) stores various kinds of data, referred to hereinafter, including data items of electric potentials measured by the potential sensor 4 in association with respective positions on the outer peripheral surface of the photosensitive drum 1. The primary current-generating section 106 generates and supplies the primary current to the charging section 2. The laser drive circuit 107 drives the exposure section 3 to irradiate laser light to the photosensitive drum 1.

The potential controller 108 controls the potential sensor 4 and causes the potential sensor 4 to output a measurement result to the main unit controller 101. The development bias-generating section 109 generates and applies development bias voltage to the development section 5. The transfer current-generating section 110 generates and supplies transfer current to the transfer section 7. The photosensitive drum HP sensor 11 (reference detection unit) detects the home position of the photosensitive drum 1. The photosensitive drum phase control section 111 controls the rotational phase of the photosensitive drum 1 with reference to the detected home position of the photosensitive drum 1. The forgery-preventive ground pattern-creating section 112 creates and delivers a ground pattern for preventing forgery when copying is performed using the image forming apparatus, to the image processing section 103.

Figure 2:
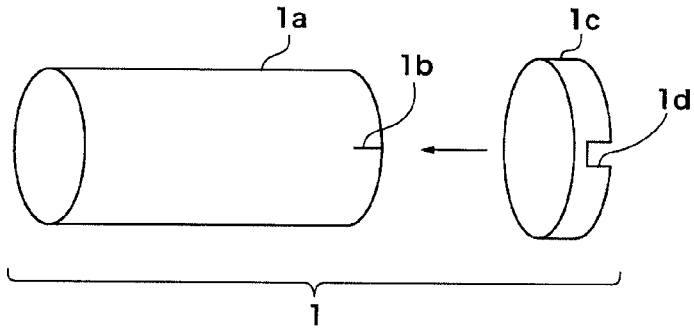
FIG. 2 is a schematic perspective view of a photosensitive drum of the image forming apparatus.

FIG. 2 is a schematic perspective view of the photosensitive drum of the image forming apparatus.

In FIG. 2, the photosensitive drum 1 comprises a photosensitive drum main body 1*a* in the form of a hollow cylinder, which has a reference mark 1*b* formed on the outer peripheral surface thereof, and a flange 1*c* in the form of an annulus, which has a photosensitive drum HP sensor flag 1*d* formed therein.

The reference mark 1*b* is formed to indicate a reference position on the photosensitive drum 1 in the rotational direction thereof. Sensitivity unevenness, referred to hereinafter, at each point on the outer peripheral surface of the photosensitive drum 1 is measured starting from the reference mark 1*b*.

The flange 1*c* is mounted to the photosensitive drum main body 1*a* in a direction of an arrow indicated in FIG. 2 such that a position of the photosensitive drum HP sensor flag 1*d* of the flange 1*c* circumferentially coincides with a position of the reference mark 1*b* of the photosensitive drum main body 1*a*. It should be noted that when replacing the photosensitive drum after installing the image forming apparatus, only photosensitive drum main body 1*a* is replaced which is degraded as the image forming apparatus is used. Further, in this case, a new photosensitive drum main body 1*a* is supplied together with a shading data ROM 105 for replacement, which stores electrical potential data items (sensitivity unevenness data items) corresponding respective points on the outer peripheral surface of the photosensitive drum 1.

Figure 3:
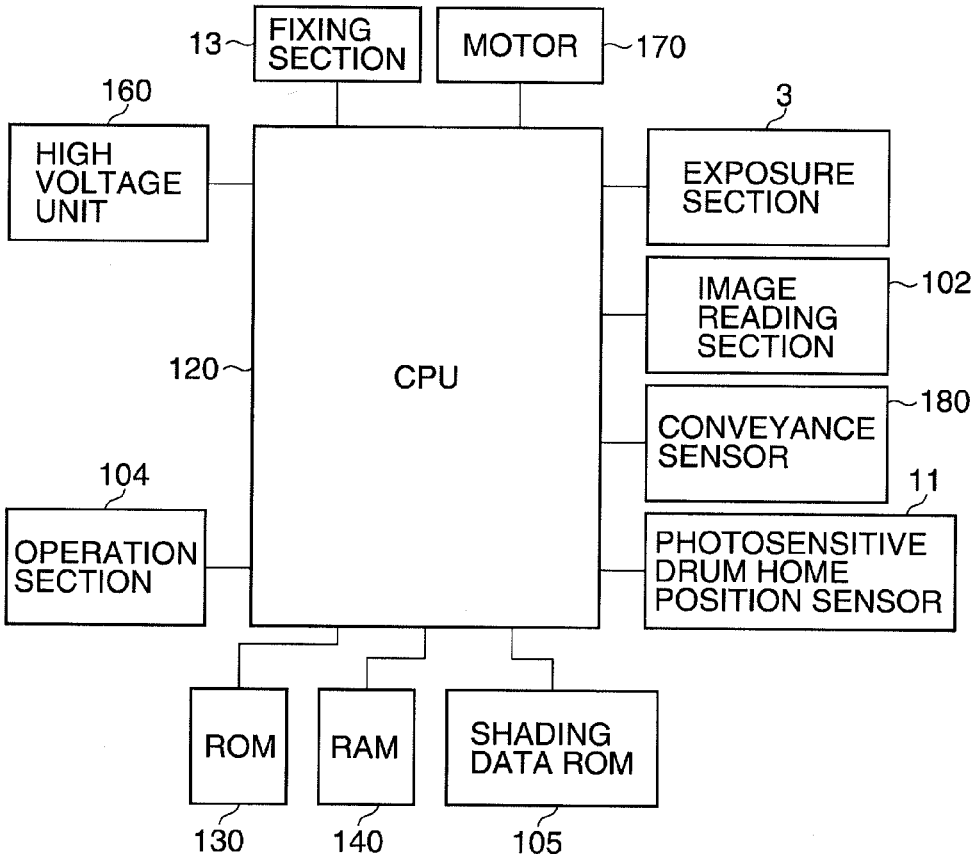
FIG. 3 is a schematic block diagram of the arrangement of essential parts of a control system of the image forming apparatus with a CPU in the center.

FIG. 3 is a schematic block diagram of the arrangement of essential parts of the control system of the image forming apparatus with the CPU 120 in the center.

In FIG. 3, the image forming apparatus comprises the CPU 120 incorporated in the main unit controller 101, a ROM 130, a RAM 140, the shading data ROM 105, a high voltage unit 160, a motor 170, and a conveyance sensor 180. It should be noted that component parts in FIG. 3 identical to those in FIG. 1 are denoted by the same reference numerals, and detailed description thereof is omitted.

The CPU 120 (a correction unit, an adjustment unit, a control unit, a determination unit, a computation unit) executes processes shown in the respective flowcharts (see FIGS. 9, 12, 15, 19, 20, and 21), described hereinafter, according to respective control programs. The ROM 130 stores the control programs and data. The RAM 140 stores stacks and control variables. The shading data ROM 105 stores data (sensitivity unevenness data) indicative of an average electrical potential at each measuring point in a state where the photosensitive drum 1 is developed (see FIG. 7) with reference to the reference mark 1*b* on the photosensitive drum 1. The sensitivity unevenness data will be described hereinafter with reference to FIG. 7.

The high voltage unit 160 generates high voltage required for forming a toner image on a recording material in the electrophotographic process, and is formed by the primary current-generating section 106, the development bias-generating section 109, and the transfer current-generating section 110. The motor 170 drives the photosensitive drum 1, conveying rollers, not shown, etc., for rotation. The conveyance sensor 180 detects a state of the recording material being conveyed on a conveying path within the image forming apparatus.

Figure 4:
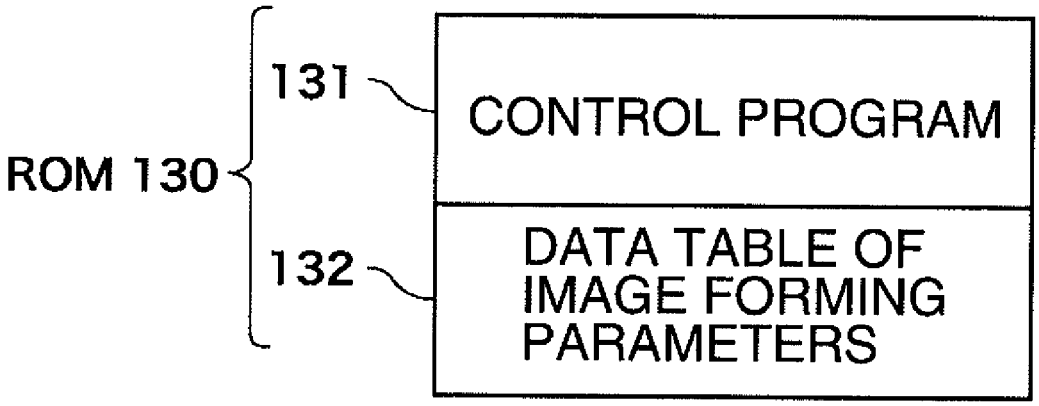
FIG. 4 is a diagram of data mapping in a ROM of the image forming apparatus.

FIG. 4 is a diagram of data mapping in the ROM 130 of the image forming apparatus.

In FIG. 4, the ROM 130 includes an area 131 storing the control programs, and an area 132 storing data tables of image forming parameters.

Figure 5:
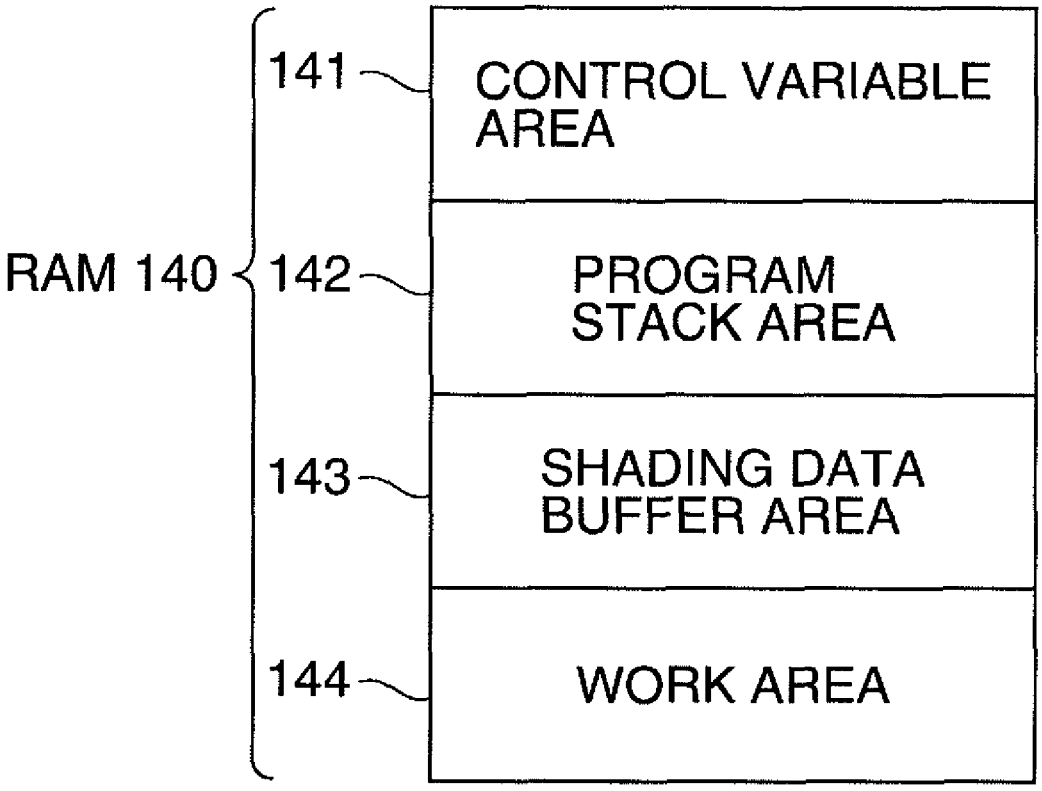
FIG. 5 is a diagram of data mapping in a RAM of the image forming apparatus.

FIG. 5 is a diagram of data mapping in the RAM 140 of the image forming apparatus.

In FIG. 5, the RAM 140 includes an area 141 for storing control variables, a program stack area 142 required for executing programs, a shading data buffer area 143 and a work area 144. The shading data buffer area 143 is an area for performing computation for increasing the accuracy of data by interpolation between a plurality of sensitivity unevenness data items on the photosensitive drum 1 which are read from the shading data ROM 105 by the CPU 120. The work area 144 is an area for storing temporary data for use in processing, including laser power correction values, referred to hereinafter, which are calculated based on sensitivity unevenness data read from the shading data ROM 105.

Figure 6:
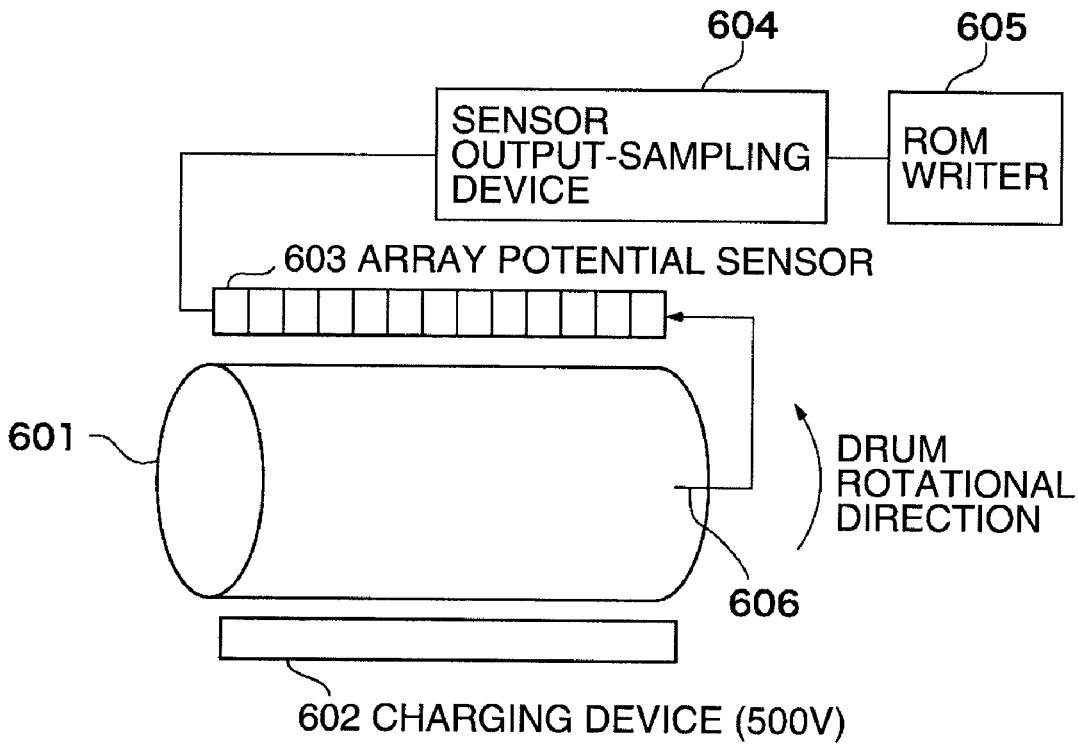
FIG. 6 is a diagram of a configuration for measuring sensitivity unevenness on an outer peripheral surface of the photosensitive drum in a photosensitive drum-manufacturing process and a configuration for storing data of the measured sensitivity unevenness.

FIG. 6 is a diagram of a configuration for measuring sensitivity unevenness on the outer peripheral surface of the photosensitive drum in a photosensitive drum-manufacturing process and a configuration for storing data of the measured sensitivity unevenness.

In FIG. 6, there is illustrated how sensitivity unevenness on the outer peripheral surface of a photosensitive drum 601 manufactured in the photosensitive drum-manufacturing process is measured, and data of the measured sensitivity unevenness is written in the shading data ROM 105 of the image forming apparatus in which the photosensitive drum 601 is to be mounted, for storage. The manufactured photosensitive drum 601 is mounted on a rotation device (not shown) for rotating the same at a predetermined speed. A charging device 602 is capable of charging the photosensitive drum 601 at e.g. 500V. An array potential sensor 603 is capable of measuring electrical potentials corresponding to respective positions on the outer peripheral surface of the photosensitive drum 601 along the axial direction thereof.

The array potential sensor 603 is capable of performing sampling of electrical potential on the surface of the photosensitive drum 601 at predetermined intervals in response to a trigger indicating detection of a reference mark 606 by a photosensitive drum HP sensor (not shown). Potential levels sampled by the array potential sensor 603 are A/D converted and buffered by a sensor output-sampling device 604. A ROM writer 605 stores the thus sampled data in an amount corresponding to one rotation of the photosensitive drum 601 in the shading data ROM 105 of the image forming apparatus as measured values of the sensitivity unevenness.

Figure 7:
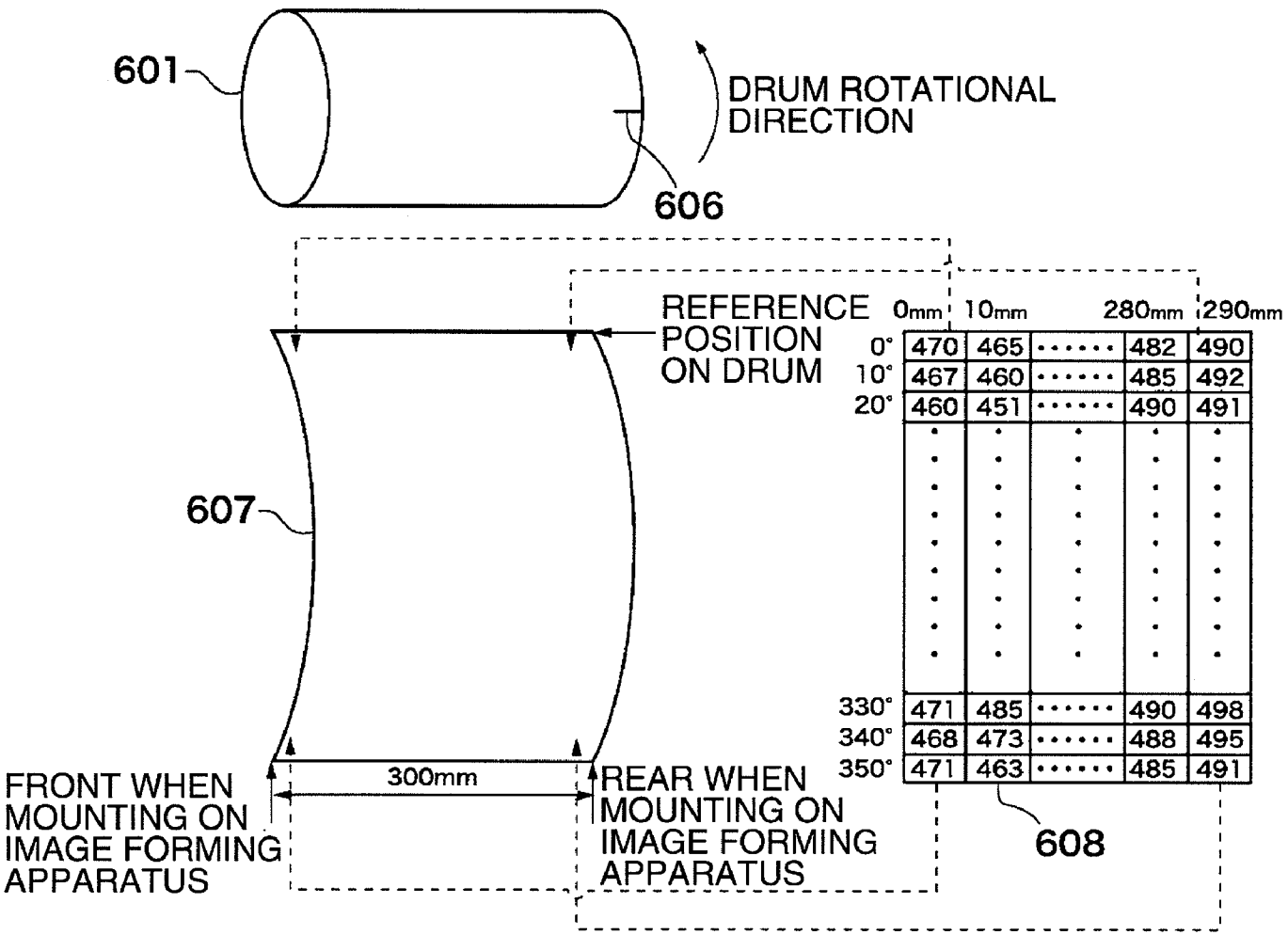
FIG. 7 is a diagram showing a relationship between positions on the outer peripheral surface of the photosensitive drum and data of the measured sensitivity unevenness.

FIG. 7 is a diagram showing a relationship between positions on the outer peripheral surface of the photosensitive drum and data of the measured sensitivity unevenness.

A reference numeral 607 in FIG. 7 indicates the outer peripheral surface of the manufactured photosensitive drum 601 in a shape formed by developing the same with reference to the reference mark 606. The shading data ROM 105 of the image forming apparatus stores a data table 608 of the values of the sensitivity unevenness measured on the photosensitive drum 601. The data table 608 stores data rows each formed by data items sequentially arranged in association with respective positions on the photosensitive drum 601 from the front side to the depth side along the axial direction thereof (in the direction of width of the developed outer peripheral surface 607 of the photosensitive drum 601), in other words, in a mounting direction of the photosensitive drum 601 when mounting the same in the image forming apparatus. An address is assigned to each data item (corresponding to each box appearing in FIG. 7) of the data table 608.

More specifically, the sensitivity unevenness data (potential level (V)) stored in the data table 608 represent average potentials measured at respective measuring points on the outer peripheral surface of the photosensitive drum 601 at every 10 mm in the axial direction and at every 10° in the rotational direction of the photosensitive drum 601, starting from a point toward the front side in the mounting direction of the photosensitive drum 601. Out of measured values of the sensitivity unevenness data stored in the data table 608, four values (470, 471, 490, and 491) measured in association with respective measuring points at four corners in the development view of the photosensitive drum 601 are illustrated by way of example using dot line arrows in FIG. 7.

Figure 8:
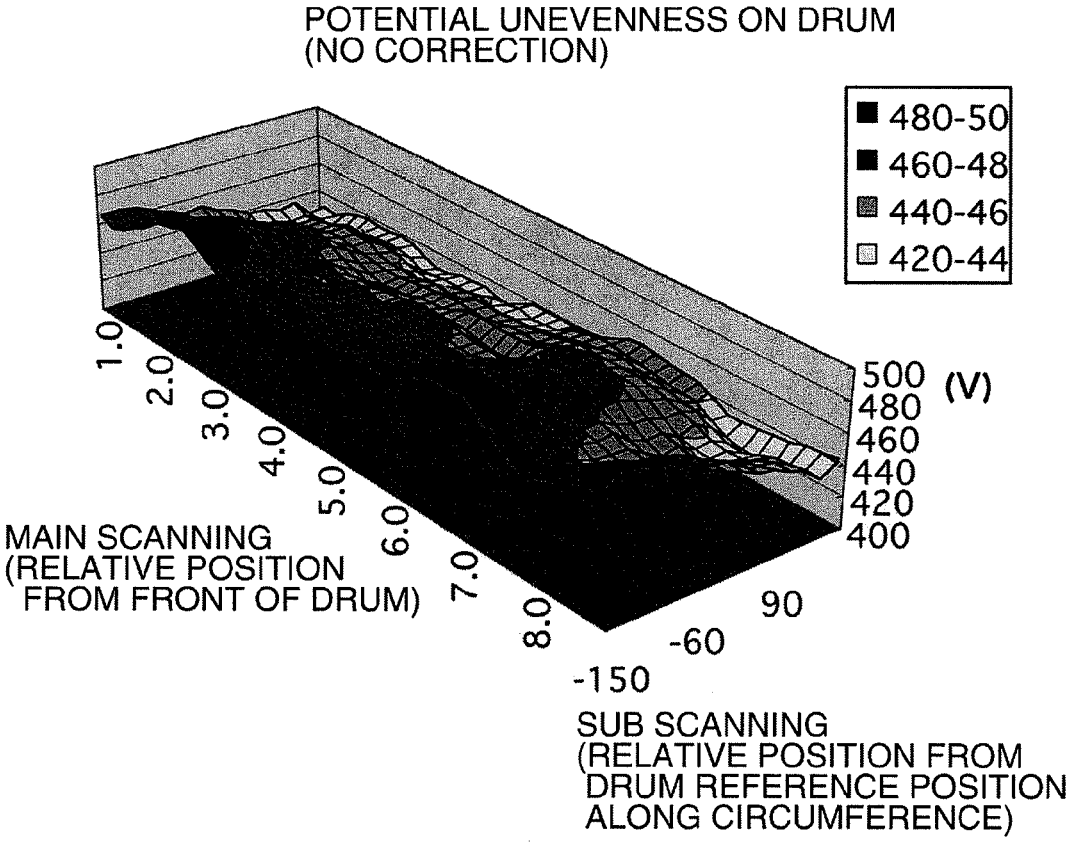
FIG. 8 is a diagram graphically showing an example of in-plane unevenness of potential characteristics of the photosensitive drum.

FIG. 8 is a diagram graphically showing an example of in-plane unevenness of potential characteristics of the photosensitive drum.

From FIG. 8, it is understood that electric potentials measured for the positions defined in the main scanning direction and the sub scanning direction of the outer peripheral surface of the photosensitive drum show variation in the in-plane unevenness in the potential characteristics (potential unevenness) not only in the direction of depth of the photosensitive drum (the main scanning direction) but also in the rotational direction of the photosensitive drum (the sub scanning direction).

Next, a computing equation used by the CPU 120 of the image forming apparatus for correcting the amount of exposure of the photosensitive drum to laser by the exposure section 3 based on the sensitivity unevenness data (potential unevenness) stored in the shading data ROM 105 in association with addresses assigned thereto is shown as follow:

$$\text{offset}=[(500-\text{Data})/500]\times 256,$$

wherein offset represents a laser power offset value and Data represents a measured value of sensitivity unevenness. Laser power with which the exposure section 3 emits laser light have 256 levels ranging from a value of 0 to a value of 255. As the measured value of the sensitivity unevenness stored in the shading data ROM 105 is smaller than 500V, which is the maximum potential to which the outer peripheral surface of the photosensitive drum is charged, the sensitivity of the photosensitive drum becomes lower, and hence it is necessary to correct the laser power such that it is reduced. To this end, the laser power offset values (laser power correction values) associated with respective positions on the outer peripheral surface of the photosensitive drum 1 to which the exposure section 3 irradiates laser are each determined based on the above equation. The laser power correction values are temporarily stored in the work area 144 of the RAM 140.

In the present embodiment, the amount of exposure onto the photosensitive drum 1 to be executed by the exposure section 3 is corrected based on the sensitivity unevenness data (electrical potential data) read from the shading data ROM 105, and based on the result of correction of the amount of exposure to be executed, timing for starting the correction of the amount of exposure actually executed onto the photosensitive drum 1 is adjusted. In doing this, the timing for starting the correction of the amount of exposure actually executed onto the photosensitive drum 1 is adjusted by adjusting the readout start address in the shading data ROM 105 when reading out the sensitivity unevenness data (electrical potential data) therefrom. Further, the timing for starting the correction of the amount of exposure actually executed onto the photosensitive drum 1 is adjusted with reference to timing in which the reference mark of the photosensitive drum 1 is detected by the photosensitive drum HP sensor 11.

Next, the operations of the image forming apparatus according to the present embodiment, configured as described above, will be described with reference to FIGS. 9 to 12.

Figure 9A:
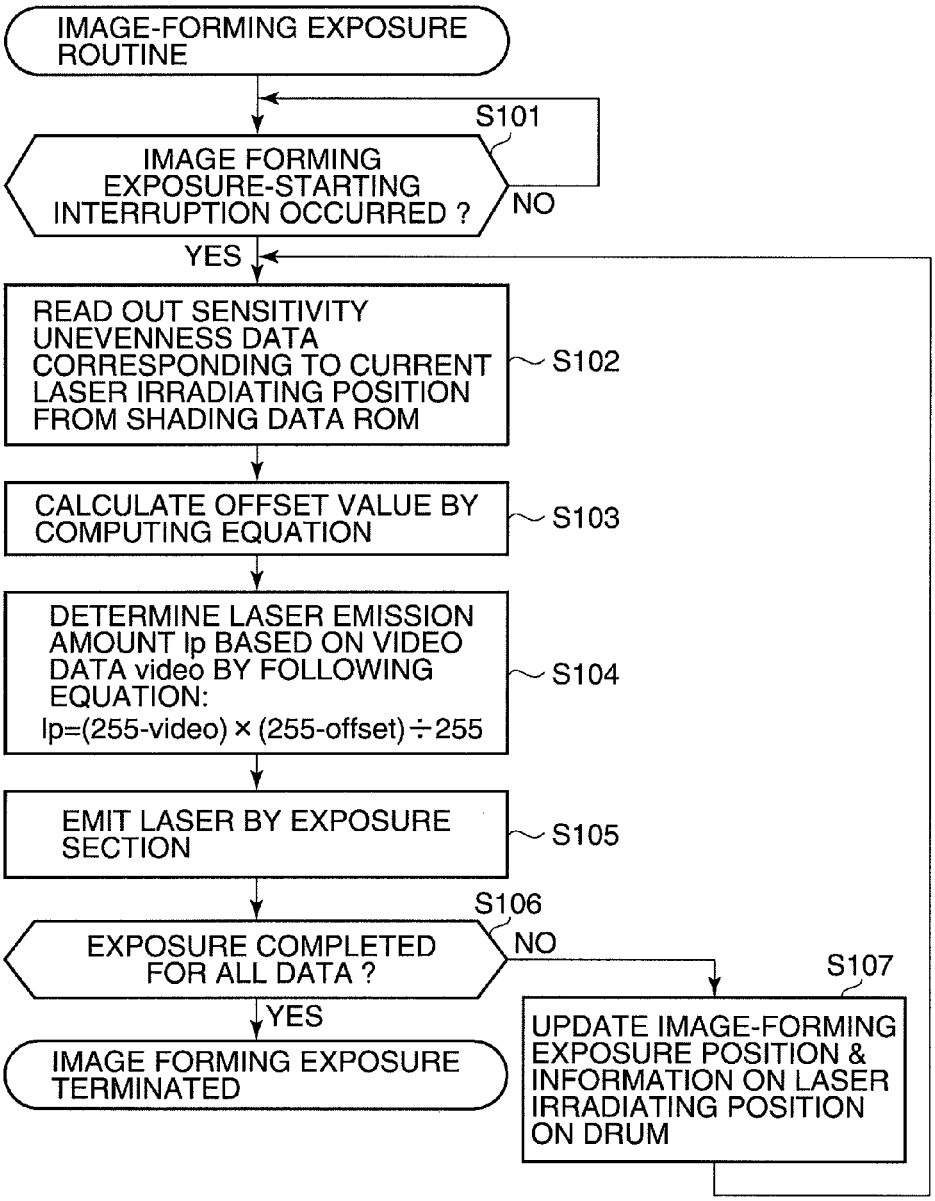
FIG. 9A is a flowchart of an image-forming exposure routine in a process for determining an exposure amount of a laser scanner when image formation is performed by the image forming apparatus.
Figure 9B:
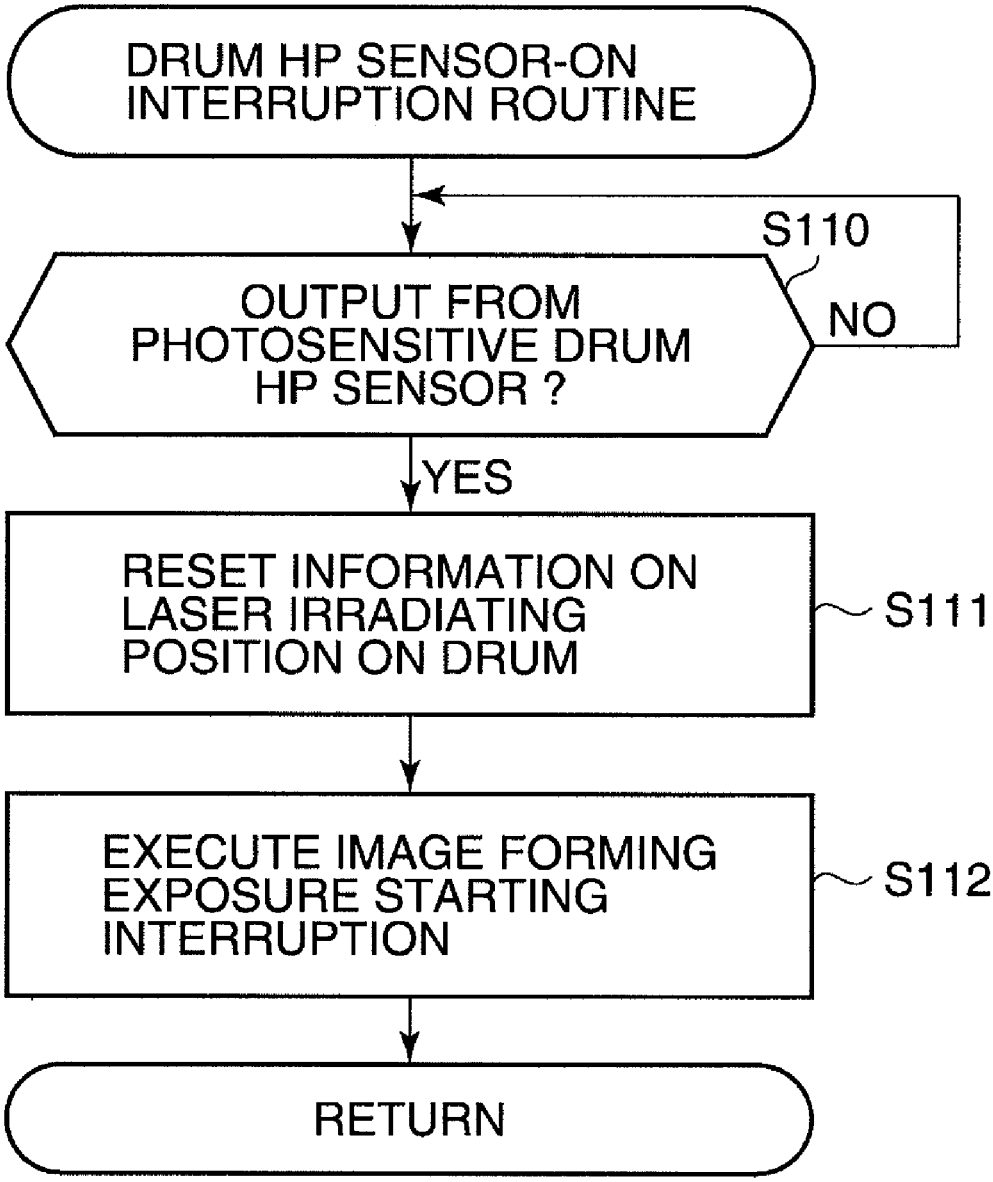
FIG. 9B is a flowchart of a photosensitive drum HP sensor-on interruption routine in the process for determining the exposure amount of the laser scanner when image formation is performed by the image forming apparatus.

FIGS. 9A and 9B show a process for determining an exposure amount of the laser scanner when image formation is performed by the image forming apparatus, in which FIG. 9A is a flowchart of an image-forming exposure routine, and FIG. 9B is a flowchart of a photosensitive drum HP sensor-on interruption routine.

In FIG. 9A, when the image-forming exposure routine is started, the CPU 120 of the image forming apparatus waits for a next interruption. The correction of the exposure amount of the photosensitive drum 1 by the exposure section 3 is started from a starting point set to timing in which the reference position on the photosensitive drum 1 (sensor flag of the flange aligned with the reference mark of the photosensitive drum main body) passes the photosensitive drum HP sensor 11. Therefore, the CPU 120 waits for an image forming exposure-starting interruption (step S101).

If the image forming exposure-starting interruption occurs, the CPU 120 reads out a measured value of the sensitivity unevenness corresponding to the current laser irradiating position on the photosensitive drum 1 to be subjected to exposure by the exposure section 3, from the shading data ROM 105 (step S102). Next, the CPU 120 calculates the laser power offset value "offset" by using the above-mentioned equation based on the measured value of the sensitivity unevenness (sensitivity unevenness data) read from the shading data ROM 105 (step S103).

Next, the CPU 120 determines a laser emission amount "lp" based on a video data item "video" for forming a pixel as a constituent of a toner image that is to be obtained by developing an electrostatic latent image formed on the photosensitive drum 1 with toner, by calculation using the following equation (step S104):

$$lp=(255-\text{video})\times(255-\text{offset})\div 255$$

The CPU 120 causes the exposure section 3 to emit laser light based on the laser emission amount "lp" determined by the above calculation (step S105). Then, the CPU 120 determines whether or not the exposure performed by the exposure section 3 in a manner associated with each of all the data items (corresponding to one page on which an image is to be formed) is completed (step S106). If the exposure performed in a manner associated with each of all the data items is not completed, the CPU 120 updates the image-forming exposure position to be exposed by the exposure section 3 and information on the laser irradiating position on the photosensitive drum 1 (step S107), and then the process returns to the step S102 to repeat the subsequent steps. If the exposure performed in a manner associated with each of all the data items is completed, the operation of image forming exposure for one page is terminated.

In FIG. 9B, the CPU 120 starts the photosensitive drum HP sensor-on interruption routine simultaneously with the image-forming exposure routine in FIG. 9A. First, it is determined whether or not an output signal indicative of passage of the reference position on the photosensitive drum 1 is delivered from the photosensitive drum HP sensor 11 (step S110). If the output signal is not delivered, this step is repeatedly executed, whereas if the output signal is delivered, the CPU 120 resets the irradiating position information indicative of the current irradiation position on the photosensitive drum 1 to which the exposure section 3 is to emit laser light (step S111). Next, the CPU 120 generates the image forming exposure starting interruption signal receipt of which is awaited in the step S101 in FIG. 9A (step S112).

Figure 10:
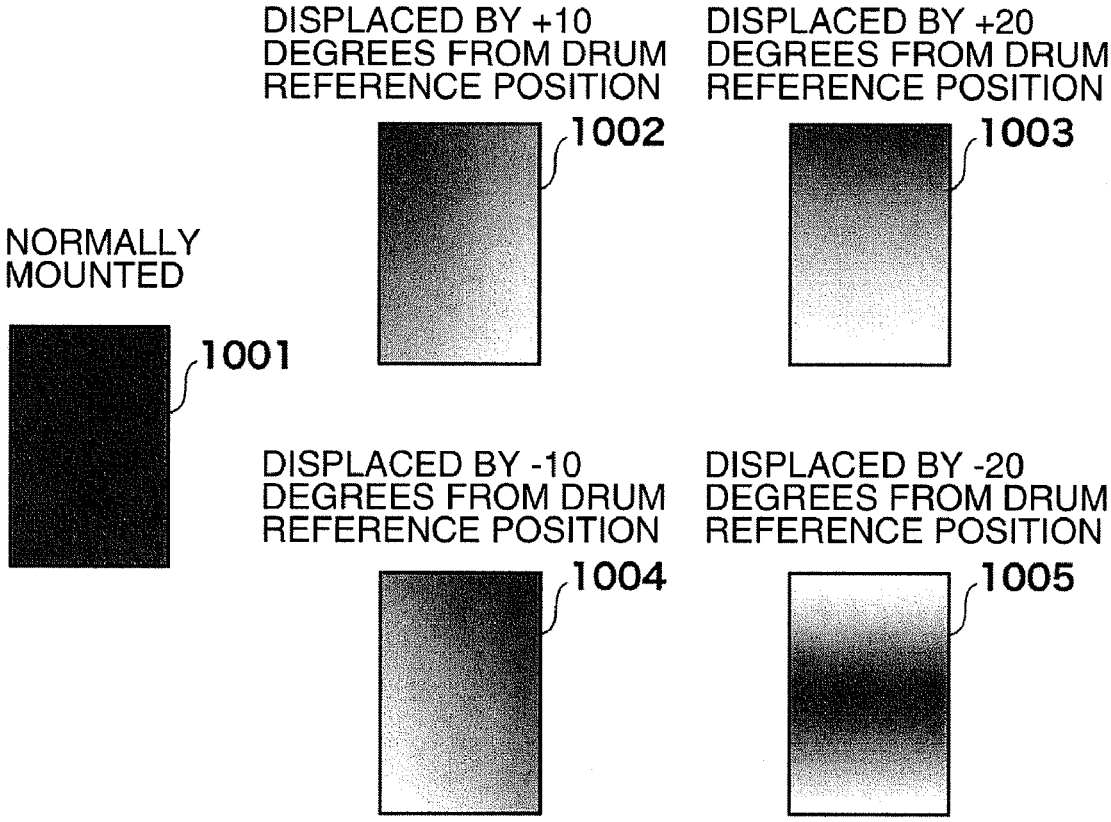
FIG. 10 is a diagram of a relationship between a condition of disposition of the reference mark of the photosensitive drum and the photosensitive drum HP sensor flag of a flange, and states of generation of density unevenness in test images.

FIG. 10 is a diagram of a relationship between a condition of disposition of the reference mark 1*b* of the photosensitive drum 1*a* and the photosensitive drum HP sensor flag 1*d* of the flange 1*c*, and states of generation of density unevenness in test images.

In FIG. 10, an image 1001 corresponds to a case where the reference mark 1*b* of the photosensitive drum main body 1*a* and the photosensitive drum HP sensor flag 1*d* (see FIG. 2) of the flange 1*c* are disposed in an accurately aligned manner (normally mounted). That is, assuming that the photosensitive drum main body 1*a* and the photosensitive drum HP sensor flag 1*d* are normally mounted, a printout of a halftone image in uniform density by the image forming apparatus gives an image in which the sensitivity unevenness of the photosensitive drum is resolved.

An image 1002 indicates a case where the photosensitive drum HP sensor flag 1*d* of the flange 1*c* is disposed in a manner displaced from the reference mark 1*b* of the photosensitive drum main body 1*a* by 10 degrees in a normal rotational direction of the photosensitive drum main body 1*a*. An image 1003 indicates a case where the photosensitive drum HP sensor flag 1*d* of the flange 1*c* is disposed in a manner displaced from the reference mark 1*b* of the photosensitive drum main body 1*a* by 20 degrees in the normal rotational direction of the photosensitive drum main body 1*a*.

An image 1004 indicates a case where the photosensitive drum HP sensor flag 1*d* of the flange 1*c* is disposed in a manner displaced from the reference mark 1*b* of the photosensitive drum main body 1*a* by 10 degrees in a reverse rotational direction of the photosensitive drum main body 1*a*. An image 1005 indicates a case where the photosensitive drum HP sensor flag 1*d* of the flange 1*c* is disposed in a manner displaced from the reference mark 1*b* of the photosensitive drum main body 1*a* by 20 degrees in the reverse rotational direction of the photosensitive drum main body 1*a*.

As shown in the above-mentioned images 1002 to 1005, if the reference mark 1*b* of the photosensitive drum main body 1*a* and the photosensitive drum HP sensor flag 1*d* of the flange 1*c* are disposed in a displaced manner, there is caused a mismatch between a laser power correction value corresponding to each position on the outer peripheral surface of the photosensitive drum 1 computed based on the data stored in the shading data ROM 105 and an actual sensitivity unevenness which is to be corrected using the laser power correction value. This results in an occurrence of density unevenness in spite of the fact that the halftone image in uniform density is printed.

In the present embodiment, an image is printed on a plurality of sheets by shifting, as desired, the data readout start address from which the CPU 120 starts to read out sensitivity unevenness data (electrical potential data) from the shading data ROM 105 upon detection of the reference position of the photosensitive drum by the photosensitive drum HP sensor 11. Then, the operator compares the degree of density unevenness between the printed sheets to select one of the sheets which is lowest in density unevenness, and inputs information thereon to the image forming apparatus. According to this input, the image forming apparatus changes the aforementioned data readout start address from which the CPU 120 starts to read out the sensitivity unevenness data from the shading data ROM 105. Thus, even if the mounting positions of the photosensitive drum main body and the flange are displaced from each other, instead of performing an operation for adjusting the mounting position of the flange, the readout start address of sensitivity unevenness data is shifted, whereby it becomes possible to correct the density unevenness resolving error due to the displacement of the mounting positions of the photosensitive drum main body and the flange.

Further, the present embodiment is mainly directed to determining a data readout start address-shifting amount Soffset by which the readout start address of the sensitivity unevenness data mapped in a control variable area 501 of the RAM 140 is to be shifted for appropriate correction of the displacement between the photosensitive drum main body 1*a* and the flange 1*c*. This similarly applies to second and third embodiments, described hereinafter, of the present invention. It should be noted that instead of the method of adjusting the data readout start address-shifting amount Soffset, there may be employed a method of adjusting a time lag provided between detection of the reference position on the photosensitive drum main body 1*a* passing the photosensitive drum HP sensor 11 and resetting of the readout start address with which the sensitivity unevenness data starts to be read out.

Figure 11:
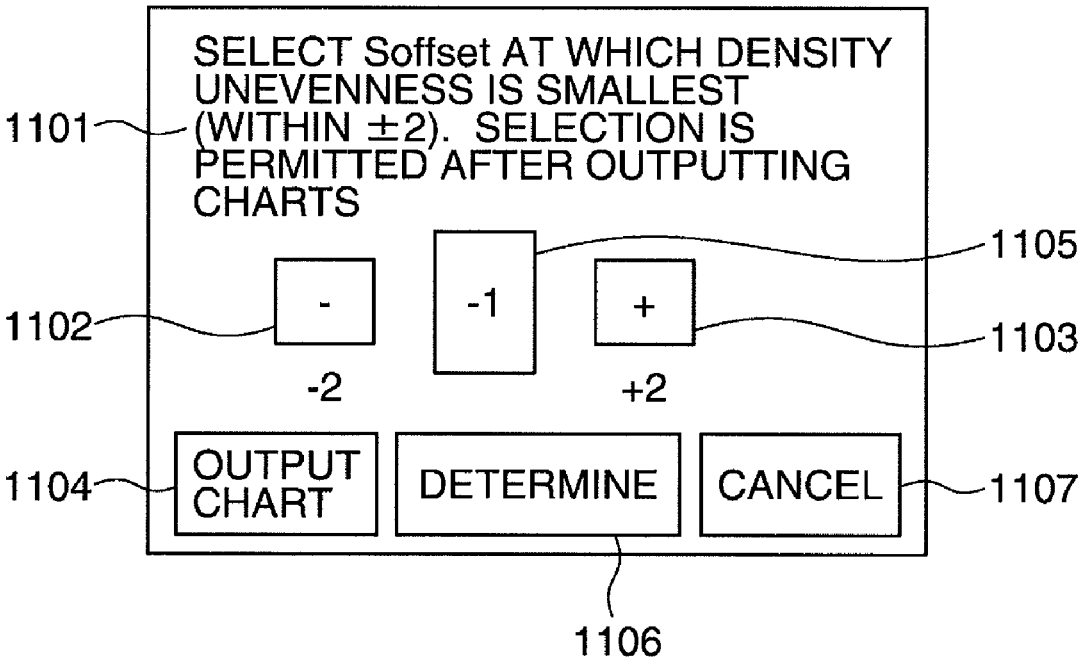
FIG. 11 is a view of a setting screen for setting a test chart for resolving density unevenness caused by displacement between the reference mark on the photosensitive drum main body and the photosensitive drum HP sensor flag of the flange, and determining a data readout start address-shifting amount.

FIG. 11 is a view of a setting screen for setting a test chart for resolving density unevenness caused by displacement between the reference mark 1*b* of the photosensitive drum main body 1*a* and the photosensitive drum HP sensor flag 1*d* of the flange 1*c* and determining the aforementioned data readout start address-shifting amount Soffset.

The setting screen shown in FIG. 11 is displayed on the operation section 104 of the image forming apparatus. A message line 1101 is an area for displaying a message for prompting the operator to determine an appropriate data readout start address-shifting amount while printing out a test chart by the image forming apparatus. Soffset input keys 1102 and 1103 are capable of shifting sensitivity unevenness data items by an amount within a range corresponding to ±2 data rows of the data table 608 shown in FIG. 7. The current Soffset setting value "−1" is displayed in a value display area 1105.

Although in the illustrated example, to limit the range which can be selected by the operator to a certain degree for simplification of the input process, the input range is set to ±2 data rows, this is not limitative, but in view of a situation where the reference mark 1*b* and the photosensitive drum HP sensor flag 1*d* cannot be to aligned in position with each other when mounting the photosensitive drum main body 1*a* and the flange 1*c*, the input range may be configured such that it can be increased to ±18 data rows (360°).

A chart output key 1104 is operated to instruct printout of a test chart after setting the data readout start address-shifting amount Soffset. A determination key 1106 is operated when the operator who confirmed the printed result of the test charts finally determines the data readout start address-shifting amount Soffset. A cancel key 1107 is operated when existing from the setting screen.

Figure 12:
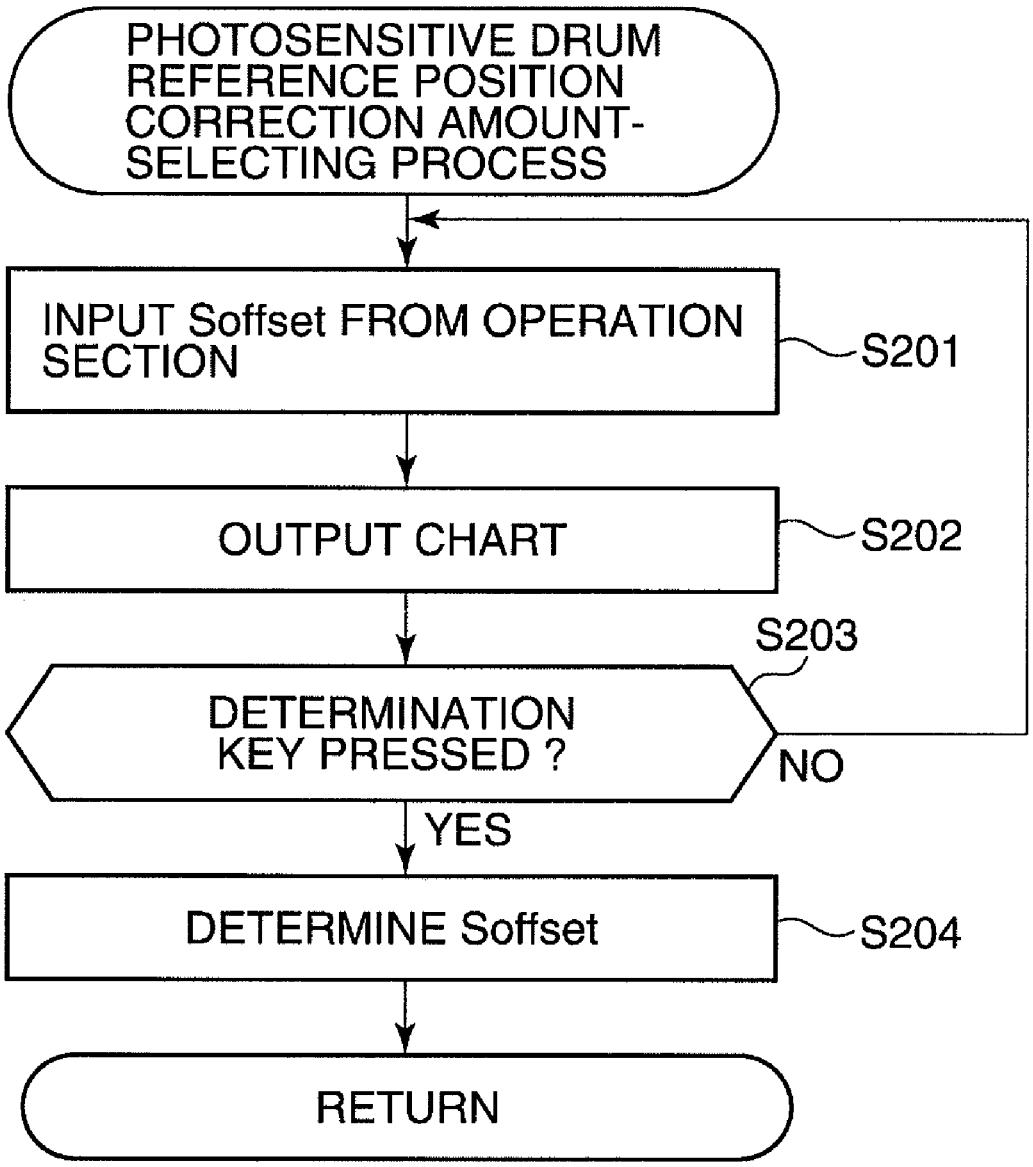
FIG. 12 is a flowchart of a photosensitive drum reference position correction amount-selecting process executed by the image forming apparatus.

FIG. 12 is a flowchart of a photosensitive drum reference position correction amount-selecting process executed by the image forming apparatus.

The photosensitive drum reference position correction amount-selecting process shown in FIG. 12 is executed to resolve density unevenness caused by the displacement between the photosensitive drum main body 1*a* and the flange 1*c*. First, the CPU 120 of the image forming apparatus retrieves a value of the data readout start address-shifting amount Soffset input from the operation section 104 by the operator (step S201). Next, the CPU 120 prints out a test chart by the image forming section based on the input value of the data readout start address-shifting amount Soffset (step S202).

It is possible to print out a test chart insofar as it is before the operator presses the determination key 1106 on the setting screen in FIG. 11 ("YES" to a step S203). Therefore, the operator can cause the image forming apparatus to print out a plurality of test charts while changing the data readout start address-shifting amount Soffset, and designate a value of the data readout start address-shifting amount Soffset at which the density unevenness is the smallest. When the user presses the determination key 1106, the CPU 120 finally determines the value of the data readout start address-shifting amount Soffset at which the density unevenness is judged to be the smallest (step S204), followed by terminating the present process.

As described above in detail, according to the present embodiment, it is possible to obtain the following advantageous effects: An image is printed on a plurality of sheets by shifting, as desired, the address of a sensitivity unevenness data item which the CPU 120 starts to read out from the shading data ROM 105 upon detection of the reference position of the photosensitive drum by the image forming apparatus. Then, the degree of density unevenness is compared between the printed sheets. Next, the operator compares the printed sheets in respect of the degree of density unevenness, and selects one of the sheets which is lowest in density unevenness, whereby the image forming apparatus changes the address (data readout start address) with which the CPU 120 starts to read out sensitivity unevenness data from the shading data ROM 105. Thus, even if the mounting positions of the photosensitive drum main body and the flange are displaced from each other, instead of performing an operation for adjusting the mounting position of the flange, the readout start address for reading out the sensitivity unevenness data is shifted, whereby it becomes possible to correct the density unevenness resolving error due to the displacement of the mounting positions of the photosensitive drum main body and the flange.

This makes it possible to resolve correction error of the in-plane unevenness in the potential characteristics caused by an insufficient mounting accuracy of the photosensitive drum, in a relatively short time period without performing the conventional operation for removing the photosensitive drum.

Next, a second embodiment of the present invention will be described. The second embodiment differs from the above-described first embodiment in points described hereinafter, but other elements of the present embodiment are identical to corresponding ones of the first embodiment (FIGS. 1 to 10), and hence are denoted by the same reference numerals, thereby omitting the description thereof.

In the present embodiment, a plurality of test charts are printed out in advance by each time shifting the readout start address in the shading data ROM 105 of the image forming apparatus, and the operator inputs a number assigned to a test chart which the operator judges to have the least density unevenness of the plurality of test charts, thereby determining the data readout start address-shifting amount.

Figure 13:
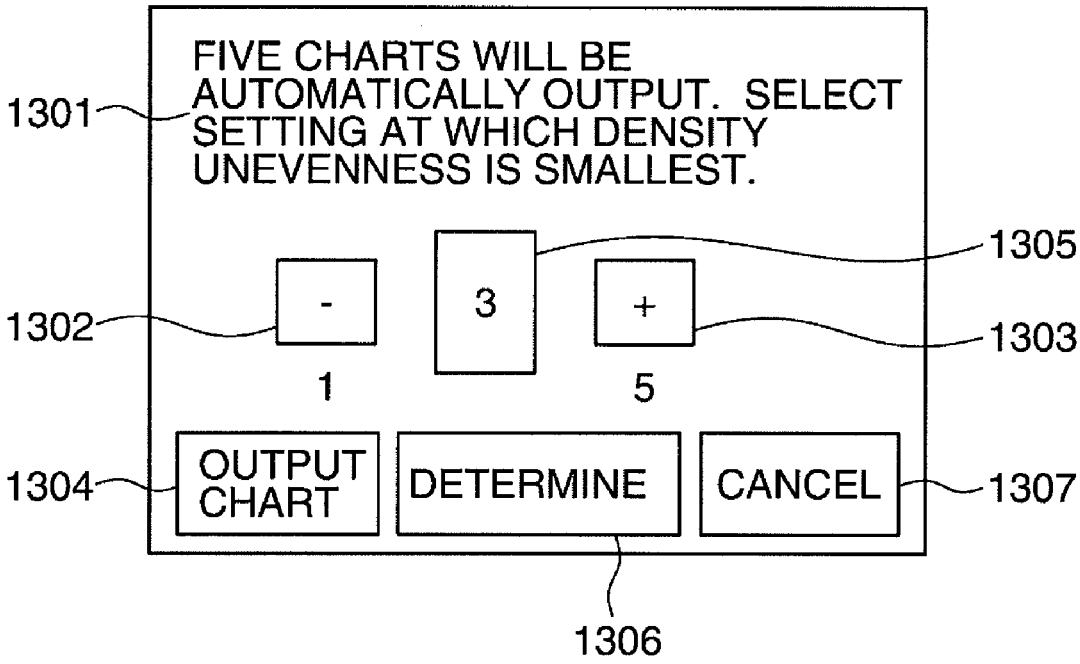
FIG. 13 is a view of a setting screen for setting test charts and determining a data readout start address-shifting amount for resolving density unevenness caused by displacement between a reference mark on a photosensitive drum main body and a photosensitive drum HP sensor flag of a flange of an image forming apparatus according to a second embodiment of the present invention.

FIG. 13 is a view of a setting screen for setting test charts and determining a data readout start address-shifting amount for resolving density unevenness caused by displacement between a reference mark on a photosensitive drum main body and a photosensitive drum HP sensor flag of a flange of the image forming apparatus according to the present embodiment.

The setting screen shown in FIG. 13 is displayed on the operation section 104 of the image forming apparatus. A message line 1301 is an area for displaying a message for prompting the operator to select a number assigned to a test chart judged to have the smallest density unevenness which is selected from the plurality of test charts printed out by the image forming apparatus. Chart selection keys 1302 and 1303 are operated when selecting the test chart having the smallest density unevenness from the five test charts, described hereinafter. A currently selected number, which is "3" in the illustrated example, is displayed on a value display area 1305.

A chart output key 1304 (instruction unit) is operated when instructing the image forming apparatus to print out e.g. five test charts. A determination key 1306 is operated when the operator determines a test chart judged to have the smallest density unevenness after confirming the printed results of the test charts. A cancel key 1307 is operated when existing from the setting screen.

Figure 14:
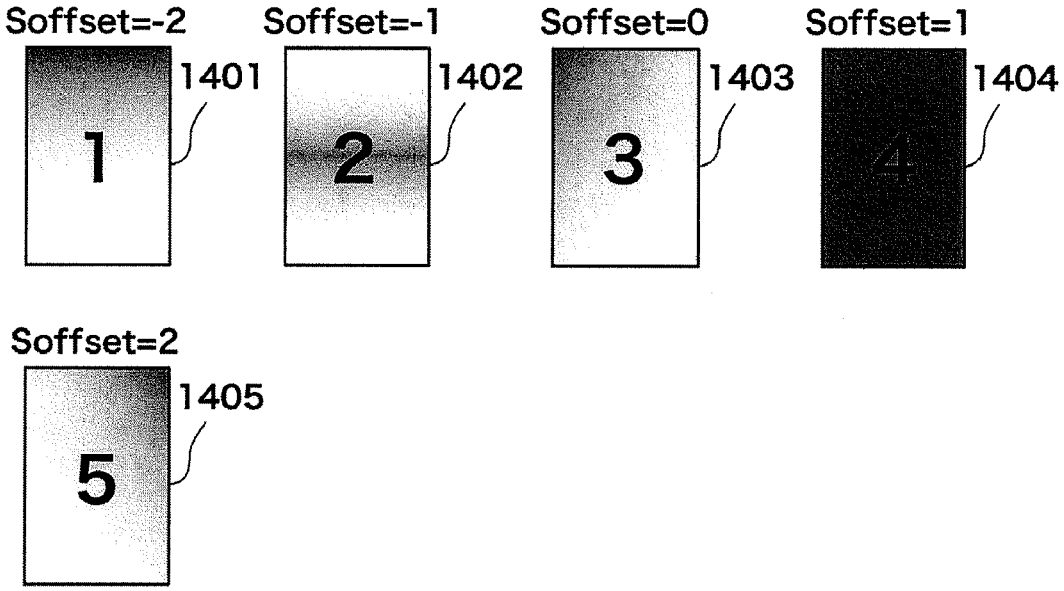
FIG. 14 is a diagram of the test charts for resolving density unevenness caused by displacement between the reference mark on the photosensitive drum main body and the photosensitive drum HP sensor flag of the flange of the image forming apparatus.

FIG. 14 is a diagram of the test charts printed for resolving density unevenness caused by displacement between the reference mark on the photosensitive drum main body and the photosensitive drum HP sensor flag of the flange of the image forming apparatus.

In FIG. 14, when the chart output key 1304 on the setting screen in FIG. 13 is operated by the operator to thereby instruct to output an image having uniform density in order to confirm the result of the exposure amount correction, the CPU 120 of the image forming apparatus causes the image forming apparatus to execute the following printout: As illustrated in FIG. 14, the CPU 120 causes the image forming apparatus to print out a half tone image having uniform density on a plurality of recording sheets by shifting the readout start address from one to another in the shading data ROM 105 for reading sensitivity unevenness data (electrical potential data) therefrom.

The test charts 1401 to 1405 are the printouts of the half tone image having uniform density on the recording sheets. The test charts 1401 to 1405 are printed out by setting the data readout start address-shifting amount Soffset of the readout start address for reading out the sensitivity unevenness data to the illustrated values (−2, −1, 0, 1, and 2), respectively. Further, on the test charts 1401 to 1405, there are printed respective numbers for the operator to select a value of the data readout start address-shifting amount Soffset by selecting one of the numbers. The operator inputs one of the numbers printed on the respective test charts 1401 to 1405 from the operation section 104, whereby a selected one of the values of the data readout start address-shifting amounts Soffset is input to the CPU 120.

Figure 15:
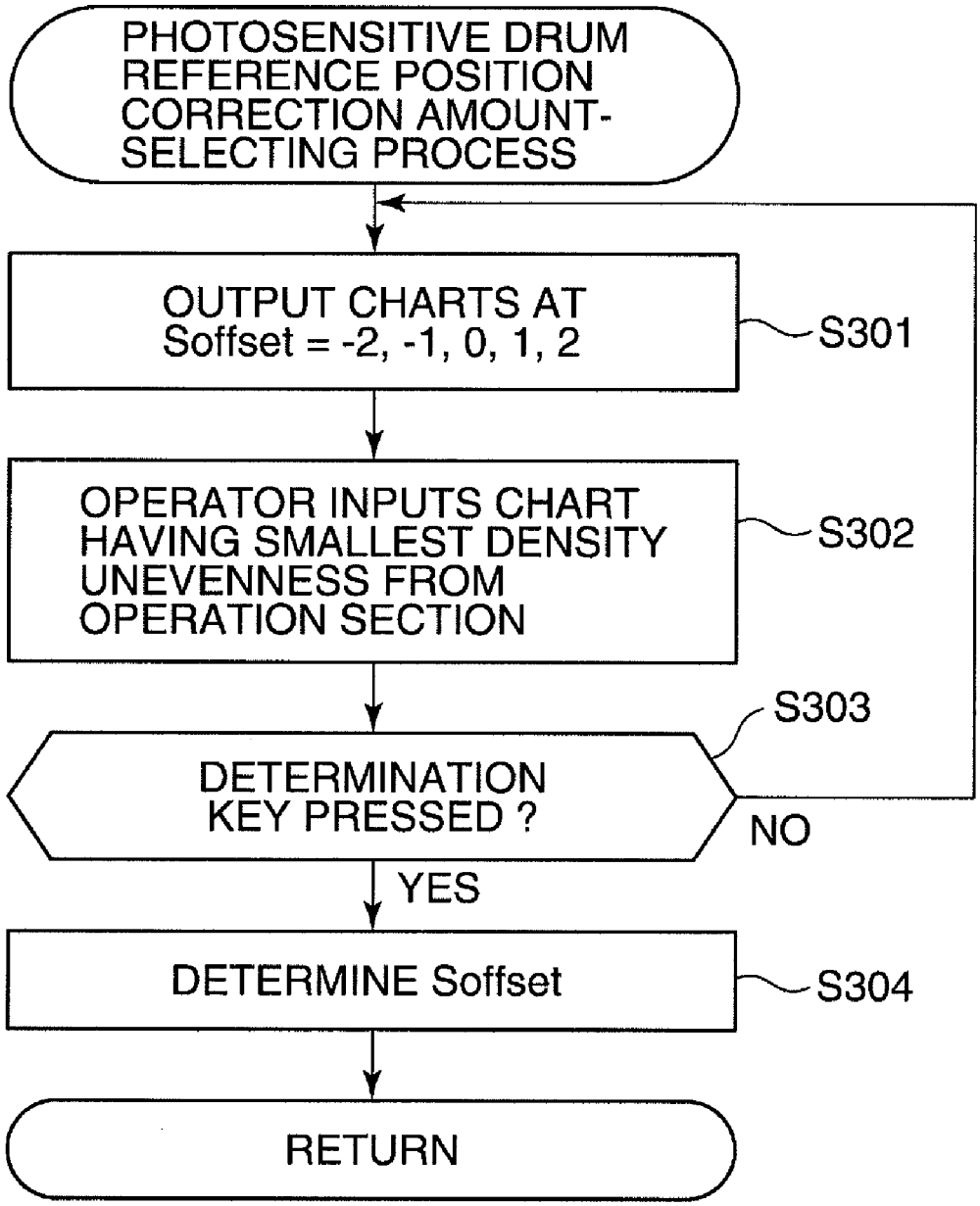
FIG. 15 is a flowchart of a photosensitive drum reference position correction amount-selecting process executed by the image forming apparatus.

FIG. 15 is a flowchart of a photosensitive drum reference position correction amount-selecting process executed by the image forming apparatus.

In FIG. 15, the present process is executed to resolve density unevenness caused by displacement between the photosensitive drum main body 1*a* and the flange 1*c*. The CPU 120 of the image forming apparatus causes the image forming section to print out test charts by changing the data readout start address-shifting amount Soffset from −2 to +2 (i.e. −2, −1, 0, +1, and +2) (step S301).

Next, the CPU 120 retrieves the number printed on the test chart judged to have the smallest density unevenness out of the five test charts, which is input from the setting screen (see FIG. 13) of the operation section 104 by the operator (step S302). Next, if the operator presses the determination key ("YES" to a step S303), the CPU 120 finally determines the data readout start address-shifting amount Soffset at which the density unevenness is judged to be the smallest (step S304), followed by terminating the present process.

As described above in detail, according to the present embodiment, it is possible to resolve correction error of the in-plane unevenness in the potential characteristics caused by an insufficient mounting accuracy of the photosensitive drum, in a relatively short time period without performing the conventional operation for removing the photosensitive drum.

Next, a third embodiment of the present invention will be described. The third embodiment differs from the above-described first embodiment in points described hereinafter, but other elements of the present embodiment are identical to corresponding ones of the first embodiment, and hence are denoted by the same reference numerals, thereby omitting the description thereof.

In the present embodiment, the image forming apparatus is provided with a patch density detection sensor 14 for detecting density (density in a patch image) in a toner image formed on the photosensitive drum 1. Further, a plurality of toner images are formed on the photosensitive drum 1 by shifting the readout address in the shading data ROM 105, and a data readout start address-shifting amount at which a deviation in density of the toner image (patch image) detected by the patch density detection sensor 14 is the smallest is finally determined.

Figure 16:
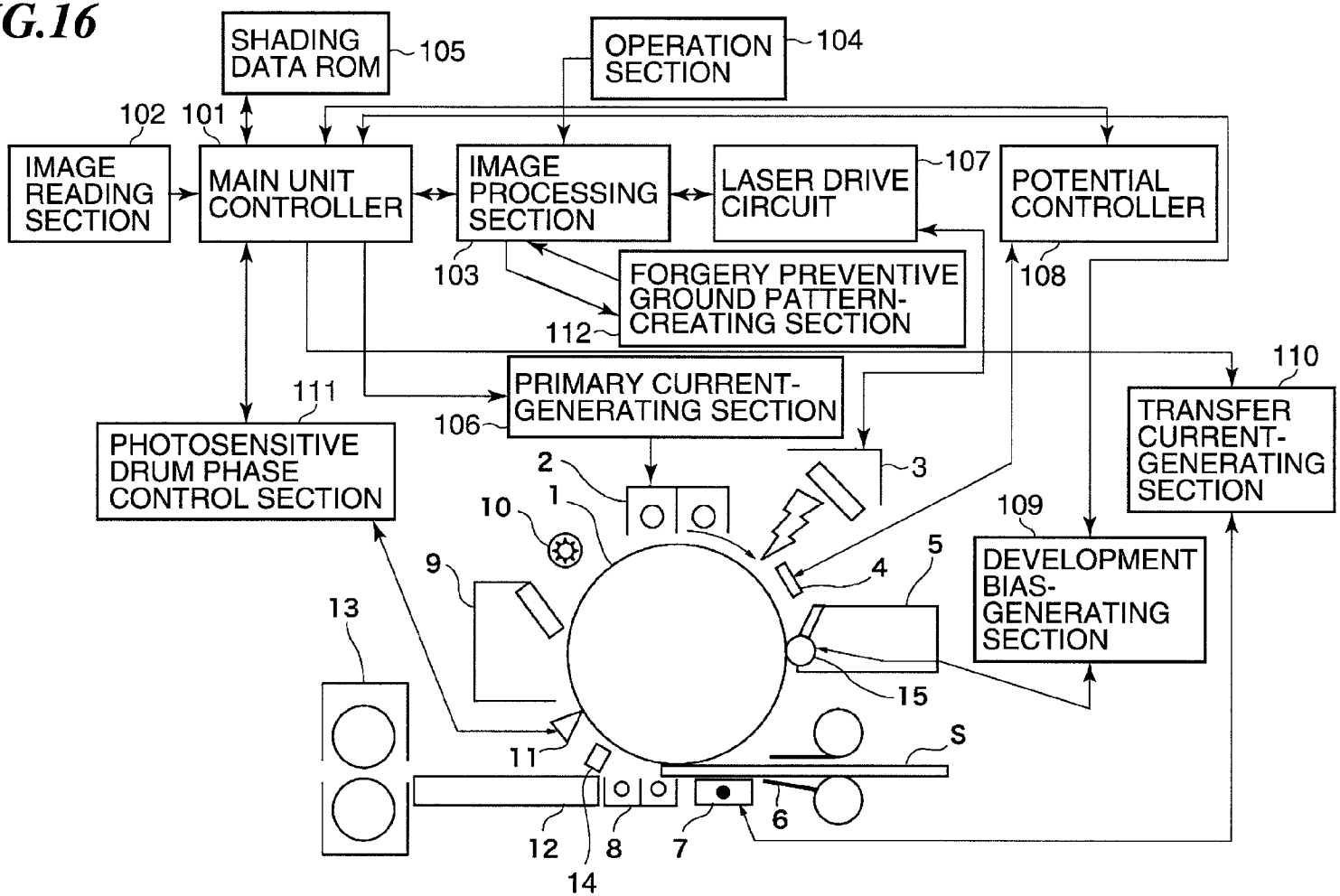
FIG. 16 is a schematic block diagram of an image forming apparatus according to a third embodiment of the present invention.
Figure 17:
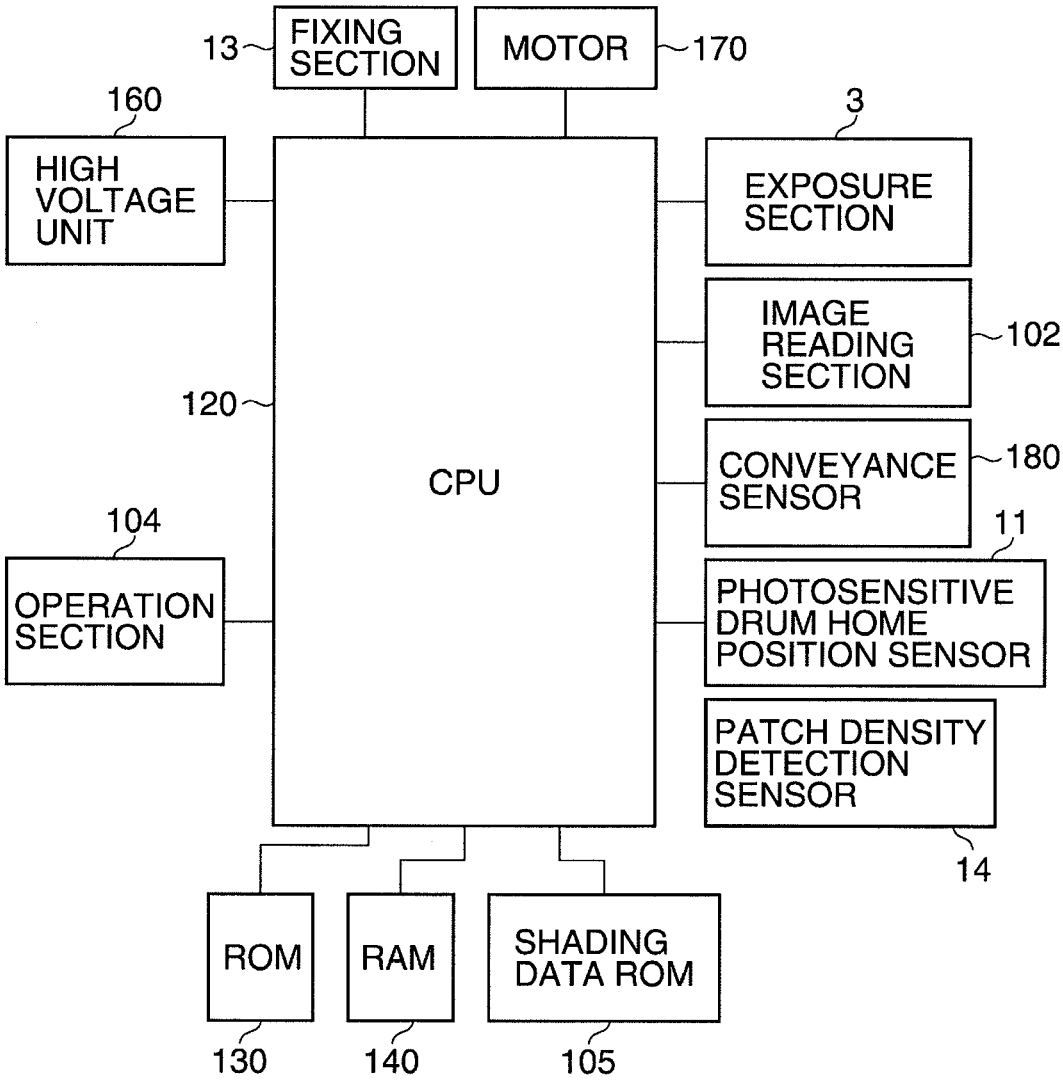
FIG. 17 is a schematic block diagram of the arrangement of essential parts of the control system of the image forming apparatus with a CPU in the center.

FIG. 16 is a schematic block diagram of the image forming apparatus according to the present embodiment. FIG. 17 is a schematic block diagram of the arrangement of essential parts of a control system of the image forming apparatus with a CPU in the center.

In FIGS. 16 and 17, the image forming apparatus of the present embodiment differs from that of the first embodiment in that the image forming apparatus is provided with the patch density detection sensor 14. Other points of the construction of the image forming apparatus than this are identical to those of the first embodiment, and hence detailed description thereof is omitted. The patch density detection sensor 14 irradiates light to a toner image (patch image) formed on the photosensitive drum 1 from a light source (e.g. LED, not shown), and detects an amount of light reflected from the toner image. This makes it possible to detect the density of an image formed by the image forming apparatus.

Figure 18:
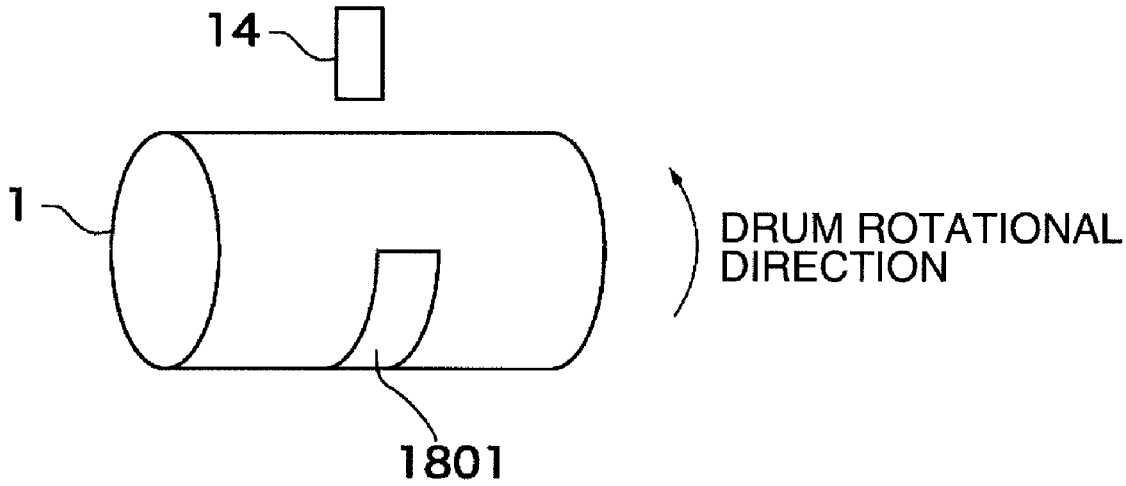
FIG. 18 is a diagram of an arrangement for performing density detection using a patch density detection sensor of the image forming apparatus.

FIG. 18 is a diagram of an arrangement for performing density detection using a patch density detection sensor of the image forming apparatus.

Referring to FIG. 18, in a state where correction of the in-plane unevenness in the potential characteristics of the photosensitive drum 1 is performed as described in the above first embodiment, the CPU 120 causes a toner image (patch image) 1801 to be formed by uniformly developing an electrostatic latent image formed on the outer peripheral surface of the photosensitive drum 1 to a predetermined density. Further, the patch density detection sensor 14 (density detecting unit) samples (detects) an amount of light reflected from the toner image 1801. The CPU 120 acquires the result of sampling from the patch density detection sensor 14 and stores the same in the RAM 140.

That is, the CPU 120 can determine the density of the patch image on the photosensitive drum 1 by acquiring values indicative of the result of sampling by the patch density detection sensor 14 and averaging the same. The toner image 1801 is formed on the photosensitive drum as it performs one rotation (along the whole circumference of the photosensitive drum). This makes it possible to confirm changes in density of the patch image for an entire rotation of the photosensitive drum.

Figure 19:
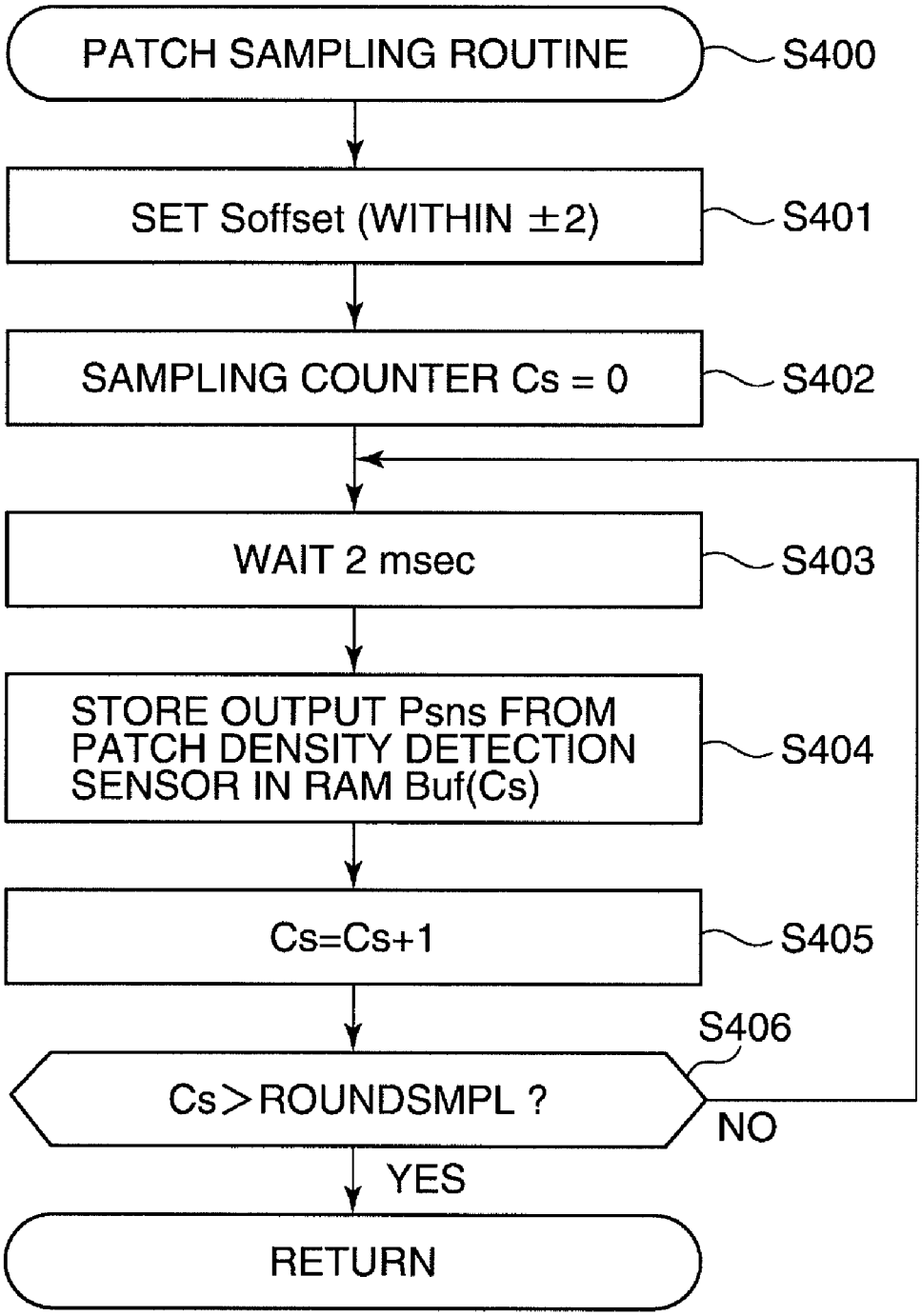
FIG. 19 is a flowchart of a patch density sampling routine for determining a data readout start address-shifting amount for use in reading out sensitivity evenness data from a shading data ROM of the image forming apparatus.

FIG. 19 is a flowchart of a patch density sampling routine for finally determining a data readout start address-shifting amount for use in reading out the sensitivity unevenness data from the shading data ROM 105 of the image forming apparatus.

In FIG. 19, when the patch density sampling routine is started (step S400), the CPU 120 of the image forming apparatus sets the data readout start address-shifting amount Soffset to a predetermined value (within a range of ±2) based on the input from the operation section 104 by the operator (step S401). Next, the CPU 120 initializes a sampling counter Cs for use in sampling toner images (patch images) along with one rotation of the photosensitive drum by the patch density detection sensor 14, to 0 (step S402). In the present embodiment, the sampling interval is set to 2 msec. Therefore, the CPU 120 waits 2 msec (step S403), and stores an output Psns from the patch density detection sensor 14 in a buffer Buf[Cs] of the RAM 140 (step S404).

Thereafter, the CPU 120 continues sampling by the patch density detection sensor 14, while incrementing the sampling counter Cs (step S405). If the number of times of sampling by the patch density detection sensor 14, which is counted using a time counter, not shown, that counts time at a repetition period of 2 msec as the photosensitive drum performs one rotation, reaches a predetermined value ROUNDSMPL ("YES" to a step S406), the CPU 120 terminates the present process.

Figure 20:
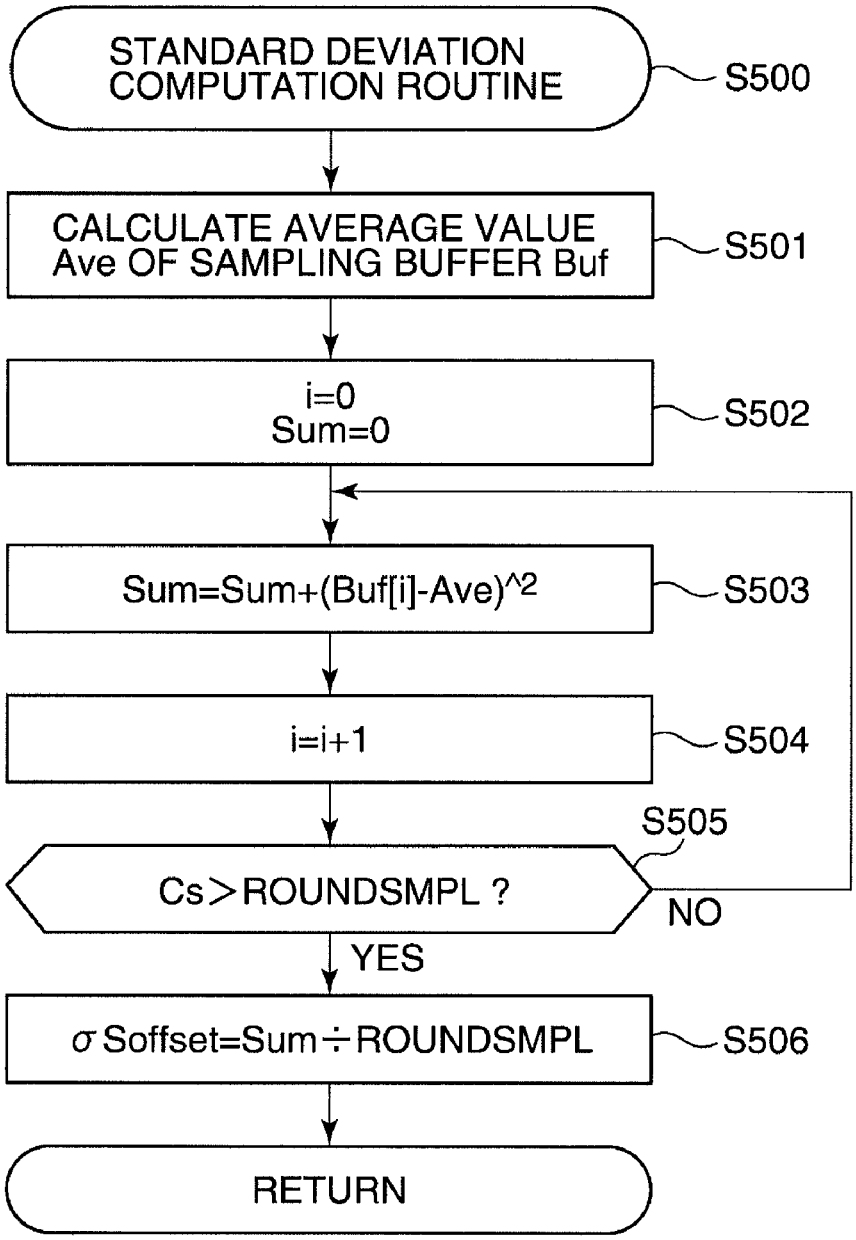
FIG. 20 is a flowchart of a standard deviation computation routine for determining a standard deviation of variation in patch density occurring at each data readout start address-shifting amount, based on the result of sampling of patch density performed for the photosensitive drum of the image forming apparatus.

FIG. 20 is a flowchart of a standard deviation computation routine for determining a standard deviation of variation in patch density occurring at each data readout start address-shifting amount Soffset, based on the results of the sampling of patch density performed for the photosensitive drum of the image forming apparatus.

In FIG. 20, when the standard deviation computation routine is started (step S500), the CPU 120 of the image forming apparatus calculates an average value Ave of values of the buffer Buf[i] of the RAM 140, which have been stored by sampling during the process in FIG. 19 (step S501). Next, the CPU 120 initializes a variable i of the buffer Buf[i] to 0 (i=0), and initializes a sum Sum for summarizing variations occurring for one rotation of the photosensitive drum (Sum=0) (step S502).

Next, the CPU 120 repeatedly executes cumulative calculation of a square of the difference between the value of the buffer Buf[i] and the average value Ave over one rotation of the photosensitive drum (steps S503 and S504). Next, if the number of times of execution of the above-mentioned cumulative calculation reaches the predetermined value ROUNDSMPL ("YES" to a step S505), the CPU 120 determines a standard deviation σSoffset by dividing the sum Sum by the predetermined number ROUNDSMPL (step S506). Then, the present process is terminated.

Figure 21:
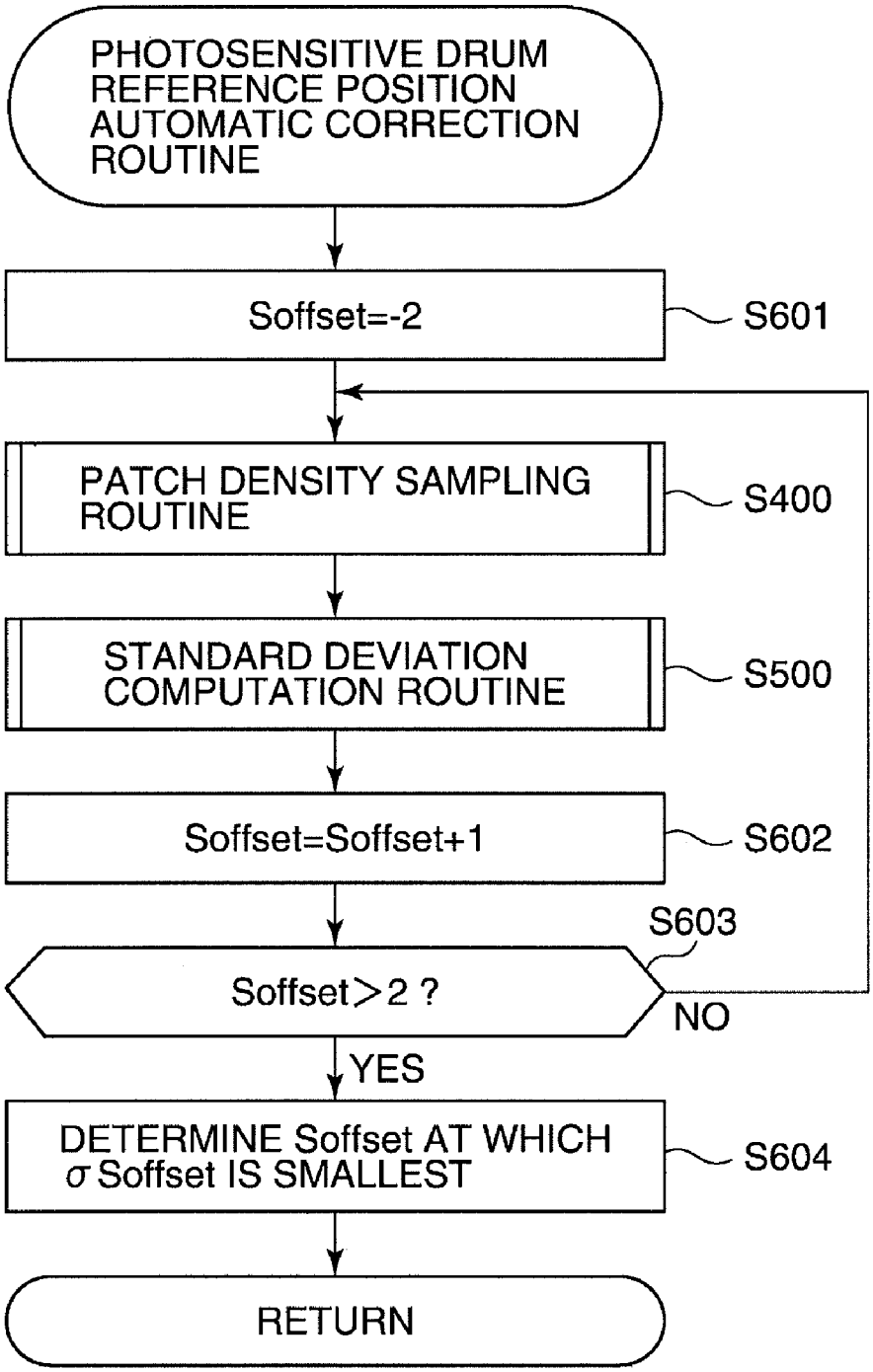
FIG. 21 is a flowchart of a photosensitive drum reference position automatic correction routine executed by the image forming apparatus.
Figure 22:
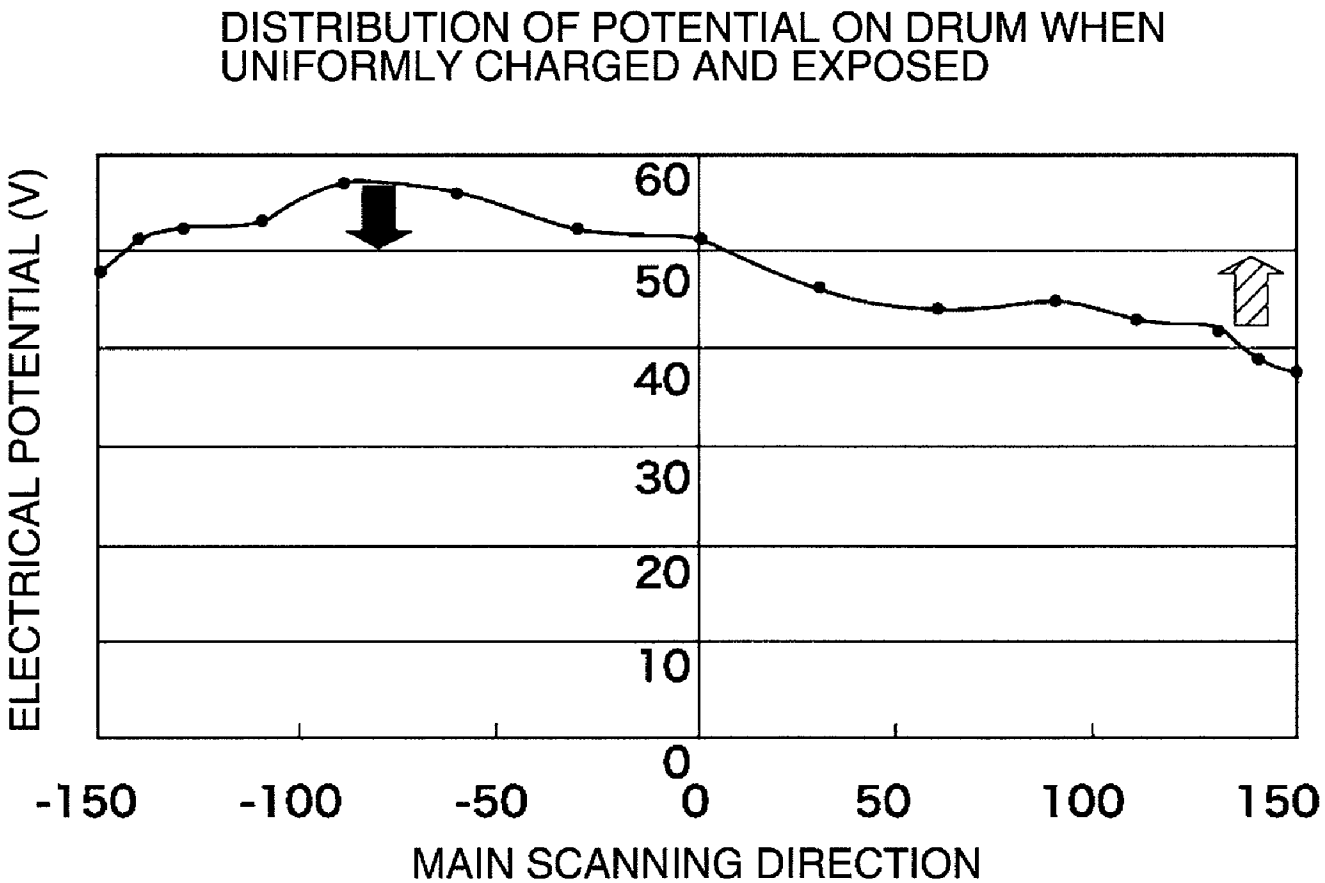
FIG. 22 is a diagram showing distribution of the electrical potential on the photosensitive drum at each point on one line in a main scanning direction when the exposure section of the image forming apparatus scans the photosensitive drum along a direction of the axis of the photosensitive drum and thereby forms an electrostatic latent image in synchronism with rotation of the photosensitive drum.

FIG. 21 is a flowchart of a photosensitive drum reference position automatic correction routine executed by the image forming apparatus.

In the present process shown in FIG. 21, an appropriate data readout start address-shifting amount Soffset is determined based on the standard deviation σSoffset of variation in patch density sampled over one rotation of the photosensitive drum, described in FIGS. 19 and 20. First, the CPU 120 of the image forming apparatus sets the data readout start address-shifting amount Soffset for the sensitivity unevenness data to −2 (step S601).

Next, the CPU 120 performs sampling of the toner images (patch images) by the patch density detection sensor 14 for one rotation of the photosensitive drum, by the patch density sampling routine described in FIG. 19 (step S400). Further, the CPU 120 determines a standard deviation σSoffset of variation in patch density by the standard deviation computation routine described in FIG. 20 based on the sampled data (step S500). Then, the CPU 120 increments the data readout start address-shifting amount Soffset by one each time to repeat the steps S400 and S500 to determine a standard deviation σSoffset until the data readout start address-shifting amount Soffset becomes equal to 2 (steps S602 and S603). Then, the CPU 120 finally determines a value of the data readout start address-shifting amount Soffset corresponding to the smallest one of the determined values of the standard deviation σSoffset as the appropriate correction value (step S604), followed by terminating the present process.

In the present embodiment, the amount of light reflected from each toner image (patch image) formed on the outer peripheral surface of the photosensitive drum 1 is sampled by the patch density detection sensor 14 while shifting the timing of reading out sensitivity unevenness data stored in the shading data ROM 105. Further, the timing for reading out the sensitivity unevenness data from the shading data ROM 105 is determined based on the standard deviation (digitized data) of variation in the density of the patch image, obtained by digitizing the result of sampling by the patch density detection sensor 14.

If the mounting position of the flange is displaced with respect to the reference position of the photosensitive drum 1, the correction of the amount of exposure of the photosensitive drum 1 to laser by the exposure section 3 deviates from the phase of the actual density unevenness of the photosensitive drum 1, and hence the standard deviation of sampled patch density becomes large. Therefore, by executing the control of the present embodiment described above, it is possible for the operator to save an effort to select an appropriate data readout start address-shifting amount Soffset as described in the first and second embodiments, whereby the usability is improved, though the provision of the patch density detection sensor increases the manufacturing cost of the image forming apparatus.

As described above, according to the present embodiment, it is possible to resolve the correction error of the in-plane unevenness in the potential characteristics caused by an insufficient mounting accuracy of the photosensitive drum, in a relatively short time period without performing the conventional operation of removing the photosensitive drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-137043, filed Jun. 8, 2009, which is hereby incorporated by reference herein in its entirety.

What is claimed is:

1. An image forming apparatus that charges an image carrier by a charging unit, exposes the image carrier by an exposure unit to thereby form an electrostatic latent image on the image carrier, and transfers an image formed by developing the electrostatic latent image by a developing unit, onto a recording material, comprising:

a storage unit configured to store electrical potential data items measured in association with respective positions on the surface of the image carrier;

a correction unit configured to correct an amount of exposure onto the image carrier by said exposure unit based on each of the electrical potential data items read from said storage unit; and an adjustment unit configured to adjust timing in which said correction unit starts correcting the amount of exposure, based on a result of correction of the amount of exposure by said correction unit.

2. The image forming apparatus according to claim 1, wherein said storage unit stores the electrical potential data items associated with the respective positions on the surface of the image carrier, by assigning an address to each of the electrical potential data items, and wherein said adjustment unit adjusts the timing in which said correction unit starts correcting the amount of exposure, by adjusting a readout start address when reading out the electrical potential data items from said storage unit.

3. The image forming apparatus according to claim 1, further comprising a reference detection unit configured to detect a reference mark which is formed on the image carrier for indicating a reference position on the image carrier, and wherein said adjustment unit adjusts the timing in which said correction unit starts correcting the amount of exposure, based on timing in which the reference mark is detected by said reference detection unit.

4. The image forming apparatus according to claim 1, further comprising:

an instruction unit configured to instruct to output images for confirming the result of correction of the amount of exposure by said correction unit; and a control unit configured to be operable when said instruction unit instructs to output images in uniform density as the images for confirming the result of correction of the amount of exposure by said correction unit performed by shifting the readout start address when reading out the electrical potential data items from said storage unit, to cause images in uniform density to be formed on recording materials, respectively, by shifting the readout start address for reading out the electrical potential data items from said storage unit.

5. The image forming apparatus according to claim 1, further comprising:

a density detection unit configured to detect density in a patch image formed on the surface of the image carrier;

a computation unit configured to digitize a result of detection of density of the patch image by said density detection unit, the patch image being formed on the surface of the image carrier while shifting timing for reading out each of the electrical potential data items from said storage unit; and a determination unit configured to determine timing for reading out each of the electrical potential data items from said storage unit, based on digitized data calculated by said computation unit.

6. The image forming apparatus according to claim 5, wherein the patch image is formed along a whole circumference of the image carrier.

7. The image forming apparatus according to claim 5, wherein the digitized data is a standard deviation of variation in density of the patch image.

* * * * *